US009176462B2

(12) United States Patent
Ohta et al.

(10) Patent No.: US 9,176,462 B2
(45) Date of Patent: Nov. 3, 2015

(54) IMAGE FORMING APPARATUS HAVING A DRAWER UNIT WITH A PAPER-FEEDING CONVEYING PATH THEREIN

(71) Applicants: Yoshihide Ohta, Kanagawa (JP); Joh Ebara, Kanagawa (JP); Hiroshi Ishii, Kanagawa (JP); Junichi Kawase, Kanagawa (JP); Kohta Takenaka, Kanagawa (JP); Tetsuji Nishikawa, Tokyo (JP); Kohta Hirakawa, Tokyo (JP); Toshihiro Shimada, Kanagawa (JP); Yusuke Funayama, Kanagawa (JP); Tsuyoshi Endo, Kanagawa (JP); Yusuke Masu, Kanagawa (JP); Makoto Suzuki, Kanagawa (JP)

(72) Inventors: Yoshihide Ohta, Kanagawa (JP); Joh Ebara, Kanagawa (JP); Hiroshi Ishii, Kanagawa (JP); Junichi Kawase, Kanagawa (JP); Kohta Takenaka, Kanagawa (JP); Tetsuji Nishikawa, Tokyo (JP); Kohta Hirakawa, Tokyo (JP); Toshihiro Shimada, Kanagawa (JP); Yusuke Funayama, Kanagawa (JP); Tsuyoshi Endo, Kanagawa (JP); Yusuke Masu, Kanagawa (JP); Makoto Suzuki, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/102,747

(22) Filed: Dec. 11, 2013

(65) Prior Publication Data

US 2014/0169828 A1 Jun. 19, 2014

(30) Foreign Application Priority Data

Dec. 13, 2012 (JP) ..... 2012-272876
Feb. 22, 2013 (JP) ..... 2013-033536

(51) Int. Cl.

*G03G 15/00* (2006.01)
*G03G 21/00* (2006.01)
*G03G 21/16* (2006.01)

(52) U.S. Cl.

CPC ..... *G03G 21/1623* (2013.01); *G03G 15/6502* (2013.01); *G03G 21/1638* (2013.01);
(Continued)

(58) Field of Classification Search

CPC ..... G03G 21/1623; G03G 21/1638; G03G 21/1695; G03G 2215/00434; G03G 2215/00544; G03G 2215/00548; G03G 2215/00713; G03G 2221/1675; G03G 2221/18684; G03G 15/6502; G03G 21/1647
USPC ..... 399/21, 23, 110, 124, 402
See application file for complete search history.

(56) References Cited

U.S. PATENT DOCUMENTS 5,134,443 A * 7/1992 Sumi et al. ..... 399/121
5,157,448 A * 10/1992 Lang ..... 399/23

(Continued)

FOREIGN PATENT DOCUMENTS

JP 01-142764 6/1989
JP 08119494 A * 5/1996

(Continued)

*Primary Examiner* — Robert Beatty
(74) *Attorney, Agent, or Firm* — Harness, Dickey & Pierce, P.L.C.

(57) ABSTRACT

An image forming apparatus having a drawer unit that includes therein a paper-feeding conveying path for conveying a recording medium conveyed from a paper feeding unit on which the recording media are stacked to an image forming unit and/or a discharge conveying path for conveying the recording medium on which an image has been formed to a discharging unit, and be drawn out from an apparatus main body; a lock unit that locks the drawer unit to the apparatus main body; a straddle detecting unit that detects whether the recording medium straddles a conveying path in the apparatus main body and a conveying path in the drawer unit; and a controller that controls the lock unit to lock the drawer unit to the apparatus main body when the straddle detecting unit detects the straddle.

16 Claims, 29 Drawing Sheets

(52) U.S. Cl.
CPC ..... *G03G21/1647* (2013.01); *G03G 21/1695* (2013.01); *G03G 2215/00544* (2013.01); *G03G 2215/00713* (2013.01); *G03G 2221/1675* (2013.01)

(56) References Cited

U.S. PATENT DOCUMENTS

| | | | | | |
|---|---|---|---|---|---|
| 5,307,116 | A | * | 4/1994 | Ikunami et al. | 399/18 |
| 5,854,965 | A | * | 12/1998 | Kasiwabara et al. | 399/381 |
| 6,089,560 | A | * | 7/2000 | Fujiwara | 271/4.1 |
| 7,334,786 | B2 | * | 2/2008 | Shinga | 271/9.11 |
| 8,145,077 | B2 | * | 3/2012 | Miyauchi | 399/21 |
| 2012/0207486 | A1 | | 8/2012 | Egawa et al. | |
| 2012/0294645 | A1 | | 11/2012 | Shimada et al. | |
| 2014/0167580 | A1 | | 6/2014 | Funayama et al. | |
| 2014/0167587 | A1 | | 6/2014 | Takenaka et al. | |

FOREIGN PATENT DOCUMENTS

| | | | | |
|---|---|---|---|---|
| JP | 10-268596 | | | 10/1998 |
| JP | 2001-261189 | | | 9/2001 |
| JP | 2005-084181 | | | 3/2005 |
| JP | 2006-145892 | | | 6/2006 |
| JP | 2006-293397 | | | 10/2006 |
| JP | 2007-175979 | | | 7/2007 |
| JP | 2008077077 | A | * | 4/2008 |
| JP | 2008120502 | A | * | 5/2008 |
| JP | 2009-042276 | | | 2/2009 |
| JP | 4340039 | | | 7/2009 |
| JP | 2012-184108 | | | 9/2012 |
| JP | 2013-008011 | | | 1/2013 |
| JP | 2014-119511 | A | | 6/2014 |
| JP | 2014-119517 | A | | 6/2014 |
| JP | 2014-119518 | A | | 6/2014 |

* cited by examiner

FIG.25

| STATE | SET DETECTION | CROSS SECTION A-A | REAR VIEW | ROTATION DETECTION |
|---|---|---|---|---|
| (a) SET DETECTED (START MOTOR ROTATION) | SET DETECTION POSITION<br>172 171 | LOCK POSITION<br>LOCK START POSITION<br>LOCKABLE SURFACE<br>162<br>183b | 180<br>162<br>181b<br>181a<br>162 | SIGNAL: NON-SHIELDING<br>162 192<br>191<br>162 |
| (b) DRAWING STARTED (MOTOR IS ROTATING) | | 162<br>183b<br>182b | 180<br>162<br>162<br>183b<br>183a | SIGNAL: NON-SHIELDING<br>192<br>191 |
| (c) DRAWING COMPLETED (STOP MOTOR ROTATION) | | 182b<br>c | 180<br>182a<br>181b<br>162<br>162<br>182b<br>181a | SIGNAL: NON-SHIELDING → SHIELDING<br>191<br>192 |
| (d) UNLOCK COMPLETED (STOP MOTOR ROTATION) | | 183b<br>182b | 180<br>181b<br>162<br>181a<br>162 | SIGNAL: SHIELDING → NON-SHIELDING<br>192<br>191 |

IMAGE FORMING APPARATUS HAVING A DRAWER UNIT WITH A PAPER-FEEDING CONVEYING PATH THEREIN

CROSS-REFERENCE TO RELATED APPLICATIONS

The present application claims priority to and incorporates by reference the entire contents of Japanese Patent Application No. 2012-272876 filed in Japan on Dec. 13, 2012 and Japanese Patent Application No. 2013-033536 filed in Japan on Feb. 22, 2013.

BACKGROUND OF THE INVENTION

1. Field of the Invention

The present invention relates to an image forming apparatus such as a printer, a facsimile, and a copying machine.

2. Description of the Related Art

In general, an image forming apparatus using an electrophotography process conveys paper as a recording medium accommodated in a paper feeding unit to an image forming unit through a paper-feeding conveying path and transfers a toner image formed by the image forming unit onto the paper. The paper onto which the toner image has been transferred is conveyed to a fixing unit and the toner image on the paper is fixed. The paper onto which the toner image has been fixed is conveyed to a discharge tray through a discharge conveying path or is conveyed to a reverse conveying path. The paper conveyed to the reverse conveying path is reversed and conveyed to the image forming unit again, and a toner image is transferred onto the back surface of the paper.

Japanese Patent No. 4340039 describes an image forming apparatus including a drawer unit that accommodates therein the above-mentioned paper-feeding conveying path and the above-mentioned reverse conveying path, and is configured to be freely drawn out from an image forming apparatus main body. When paper jam occurs in the conveying paths accommodated in the above-mentioned drawer unit, paper can be removed easily by drawing out the drawer unit from the apparatus main body.

When the paper jam occurs, paper is present in a manner of straddling the conveying path in the drawer unit and the conveying path in the apparatus main body in some cases. When the drawer unit is drawn out in this state, there arises a problem in that so-called tearing occurs to lead to difficulty in a removal operation of the paper. The tearing indicates that the paper is split into a portion at the drawer unit side and a portion in the apparatus main body to be ripped.

The image forming apparatus as described in Japanese Patent No. 4340039 detects whether or not paper is present in a manner of straddling the conveying path in the drawer unit and the conveying path in the apparatus main body when the paper jam occurred. When it detects that the paper is present in a manner of straddling them, the image forming apparatus controls to convey the straddling paper to a position at which the paper does not straddle them. This configuration can prevent occurrence of the tearing of the paper.

Furthermore, in Japanese Patent No. 4340039, a user is not notified of the occurrence of the paper jam until the straddling paper is conveyed to the position at which the paper does not straddle them in order to prevent the user from drawing out the drawer unit carelessly during the conveyance of the straddling paper.

In the image forming apparatus as described in Japanese Patent No. 4340039, when the straddling paper is long in the conveyance direction, such as paper having the lengthwise size of A3, it takes time to convey the straddling paper to the position at which the paper does not straddle them. This causes a risk that the user senses abnormality because the paper is not discharged at a usual timing and draws out the drawer unit before the paper is conveyed to the position at which the paper does not straddle them. As a result, there is a risk that the tearing of the paper occurs to lead to a difficulty in the removal operation of the paper.

The present invention has been made in view of the above-mentioned problem and an object thereof is to provide an image forming apparatus that makes it possible to prevent tearing of a recording medium from occurring.

SUMMARY OF THE INVENTION

It is an object of the present invention to at least partially solve the problems in the conventional technology.

According to the present invention, there is provided: an image forming apparatus comprising: a drawer unit configured to include therein a paper-feeding conveying path for conveying a recording medium conveyed from a paper feeding unit on which the recording mediums are stacked to an image forming unit and/or a discharge conveying path for conveying the recording medium on which an image has been formed to a discharging unit, and be capably drawn out from an apparatus main body; a lock unit configured to lock the drawer unit to the apparatus main body; a straddle detecting unit configured to detect whether or not the recording medium straddles a conveying path in the apparatus main body and a conveying path in the drawer unit; and a controller configured to control the lock unit to lock the drawer unit to the apparatus main body when the straddle detecting unit detects the straddle.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 25 is a table for explaining states of the set detecting mechanism, the lock detecting mechanism, and the like when the drawer unit shifts to be in a locked state from an unlocked state;

DETAILED DESCRIPTION OF THE PREFERRED EMBODIMENTS

Figure 1:
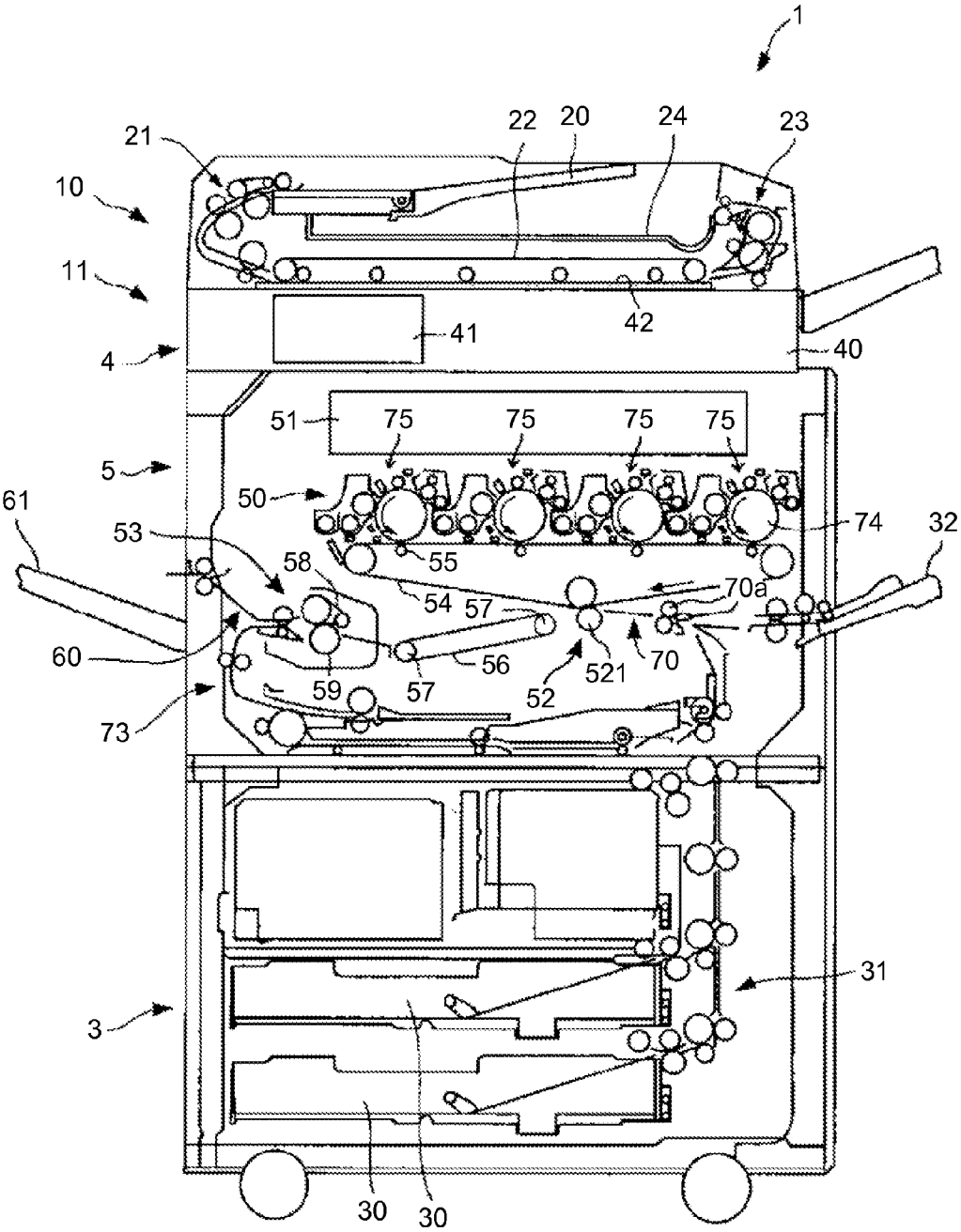
FIG. 1 is a schematic configuration view illustrating an image forming apparatus according to an embodiment.

First, described is an image forming apparatus 1 according to an embodiment of the invention with reference to FIG. 1. In the embodiment, the image forming apparatus 1 is configured as a tandem color copying machine.

As illustrated in FIG. 1, an automatic document feeder (hereinafter, referred to as ADF) 10 and an image forming apparatus main body 11 constitutes the image forming apparatus 1. Furthermore, a paper feeding unit 3, an image reading unit 4, and an apparatus main body part 5 constitutes the image forming apparatus main body 11.

The ADF 10 is configured to include a document tray 20, a document feeding roller 21, a document carriage belt 22, a document discharging roller 23, and a document discharge tray 24. The ADF 10 is attached to the image reading unit 4 so as to be freely opened and closed through an open/close mechanism (not illustrated) such as a hinge.

The document feeding roller 21 separates a document from a document bundle (not illustrated) placed on the document tray 20 one by one and conveys the document toward the image reading unit 4. The document carriage belt 22 conveys the document separated by the document feeding roller 21 to the image reading unit 4. The document discharging roller 23 discharges the document that is discharged from the image reading unit 4 by the document carriage belt 22 onto the document discharge tray 24 at the lower side of the document tray 20.

The image reading unit 4 is configured to include a housing 40, an optical scanning unit 41, a contact glass 42, and a driving unit (not illustrated).

The optical scanning unit 41 is provided in the housing 40 and includes a light-emitting diode (LED) unit. The optical scanning unit 41 irradiates the document with light from the LED unit in the main-scanning direction and scans the document in an overall irradiation region in the sub-scanning direction by the driving unit. With this, the optical scanning unit 41 reads a two-dimensional color image on the document.

The contact glass 42 is provided on an upper portion of the housing 40 of the image reading unit 4 so as to constitute the upper surface portion of the housing 40. The driving unit includes a wire (not illustrated) fixed to the optical scanning unit 41, a plurality of driven pulleys (not illustrated) and driving pulleys (not illustrated) over which the wire is bridged, and a motor for rotating the driving pulleys.

The paper feeding unit 3 includes paper cassettes 30, and a paper feeding unit 31. The paper cassettes 30 accommodate pieces of paper (not illustrated) as recording media having different paper sizes. The paper feeding unit 31 conveys the paper accommodated in the paper cassette 30 to a main conveying path 70 of the apparatus main body part 5.

The side surface of the apparatus main body part 5 is provided with a bypass tray 32 so as to be opened and closed with respect to the apparatus main body part 5. A paper bundle is stacked manually onto the tray upper surface in a state where the bypass tray 32 is opened with respect to the apparatus main body part 5. The uppermost paper of the manually-stacked paper bundle is fed toward the main conveying path 70 by a feeding roller of the bypass tray 32.

A pair of registration rollers 70*a* are arranged on the main conveying path 70. The pair of registration rollers 70*a* nip the paper conveyed on the main conveying path 70 between the rollers, and then, feed the paper toward a secondary transfer nip at a predetermined timing.

The apparatus main body part 5 includes an exposing unit 51, a tandem image forming device 50, an intermediate transfer belt 54, intermediate transfer rollers 55, a secondary transfer device 52, and a fixing unit 53. Furthermore, the apparatus main body part 5 includes the main conveying path 70, a reverse conveying path 73, and a discharging path 60.

As illustrated in FIG. 1, the exposing unit 51 is arranged so as to be adjacent to the tandem image forming device 50. The exposing unit 51 exposes photosensitive drums 74 provided for respective colors to light.

The tandem image forming device 50 includes four image forming units 75 located above the intermediate transfer belt 54. The four image forming units 75 are for yellow, cyan, magenta, and black that are located along the rotating direction of the intermediate transfer belt 54. Although not illustrated in the FIG. 1, each image forming unit 75 includes a charging device, a developing device, a photosensitive-element cleaning device, and a neutralization device around the photosensitive drum 74 provided for each color. Each photosensitive drum 74 and the above-mentioned devices provided therearound are unitized so as to constitute one process cartridge.

The tandem image forming device 50 forms visible images formed by toner (toner images) in a color-coded manner on the respective photosensitive drums 74 based on image information that has been read by the image reading unit 4 and has been color-separated. The visible images formed on the respective photosensitive drums 74 are transferred onto the intermediate transfer belt 54 at a nip between the respective photosensitive drums 74 and the intermediate transfer rollers 55.

On the other hand, the secondary transfer device 52 is provided at the opposite side to the tandem image forming device 50 with the intermediate transfer belt 54 interposed therebetween. The secondary transfer device 52 includes a secondary transfer roller 521 as a transfer member. The secondary transfer roller 521 is pressed against the intermediate transfer belt 54 so as to form the secondary transfer nip. The secondary transfer nip is configured such that the toner images formed on the intermediate transfer belt 54 are transferred onto the paper conveyed from the paper feeding unit 3 through the main conveying path 70.

The paper onto which the toner images have been transferred on the secondary transfer nip is fed to the fixing unit 53 by a paper carriage belt 56 bridged around two supporting rollers 57.

The fixing unit 53 is configured so as to press a pressing roller 59 against a fixing belt 58 serving as an endless belt. The fixing unit 53 applies heat and pressure to the paper with the pressing roller 59 so as to melt the toner of the toner images transferred onto the paper. With this, the fixing unit 53 fixes a color image onto the paper.

The paper onto which the color image has been fixed in the above-mentioned manner is stacked on a discharge tray 61 at the outside of the apparatus through the discharging path 60 serving as a discharge conveying path.

Furthermore, as illustrated in FIG. 1, the reverse conveying path 73 is provided at the lower side of the secondary transfer device 52 and the fixing unit 53. The reverse conveying path 73 is a path for turning upside down the paper discharged from the fixing unit 53, and then, feeding the paper to the secondary transfer device 52 through the main conveying path 70, again, in order to form image on back side of the paper, namely to form images on the both side of the paper.

A plurality of paper detecting sensors serving as a paper jam detecting unit are arranged on the main conveying path 70 and the reverse conveying path 73 along the conveying paths. It is to be noted that the number of paper detecting sensors and arrangement places thereof are set appropriately. When the respective paper detecting sensors do not detect passage of the paper within respective predetermined periods of time, the paper detecting sensors determine occurrence of paper jam and then the image forming apparatus 1 notifies the occurrence of the paper jam on a display unit (not illustrated) or the like thereof.

Figure 2:
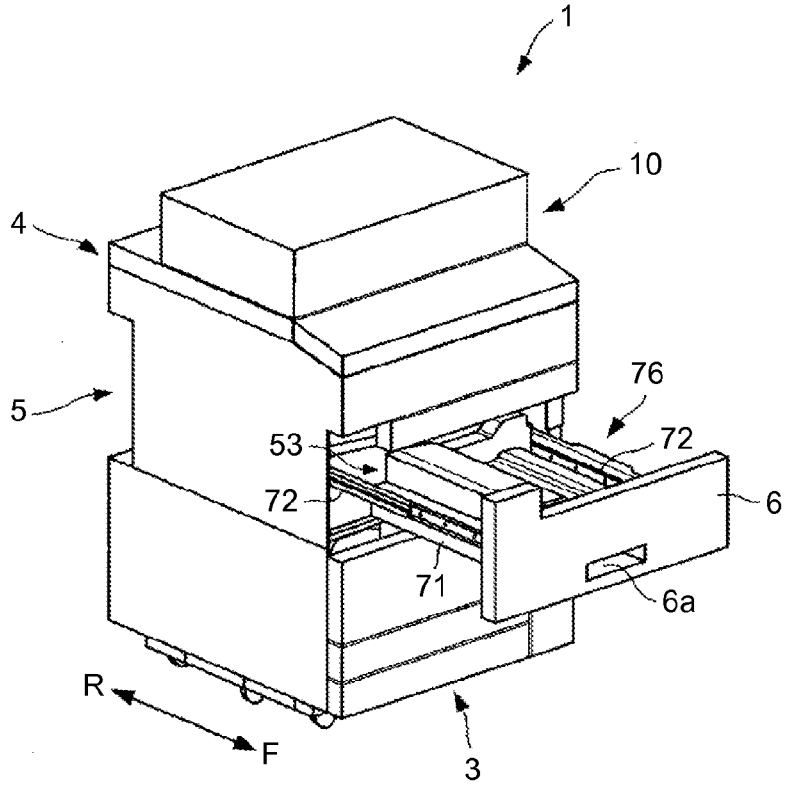
FIG. 2 is a perspective view illustrating the image forming apparatus.

The image forming apparatus 1 in the embodiment includes a drawer unit 76 (see FIG. 2). The drawer unit 76 holds the secondary transfer device 52, the fixing unit 53, the main conveying path 70, the discharging path 60, and the reverse conveying path 73 and is configured so as to be freely drawn out from the apparatus main body part 5.

FIG. 2 is a perspective view illustrating the image forming apparatus 1.

The drawer unit 76 includes a carrier 71 that holds the secondary transfer device 52, the fixing unit 53, the main conveying path 70, and the reverse conveying path 73. A front cover 6 is attached to the carrier 71. The carrier 71 is supported by rails 72 provided on the apparatus main body so as to be movable in the front-rear direction (arrowed line FR in FIG. 2) with respect to the apparatus main body part 5. A user grasps a handle part 6*a* provided on the front cover 6 so as to move the front cover 6 in the front-rear directions (arrowed line FR in FIG. 2) with respect to the apparatus main body part 5. With this, the user can draw out the drawer unit 76 from the apparatus main body part 5. In the specification, the front side F of the image forming apparatus 1 indicates the near side of the image forming apparatus 1 and the rear side R indicates the back side of the image forming apparatus 1.

Figure 3:
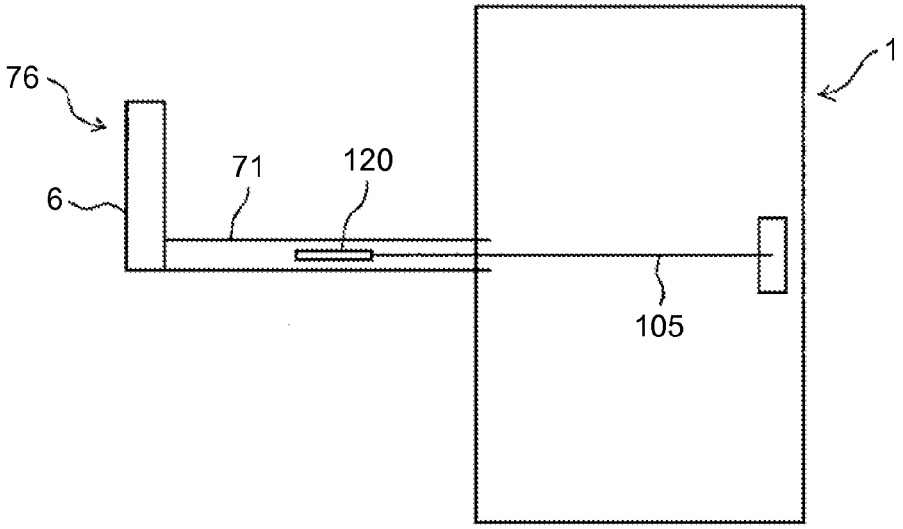
FIG. 3 is a plan view schematically illustrating a state where a drawer unit has been drawn out.

FIG. 3 is a plan view schematically illustrating a state where the drawer unit 76 has been drawn out. In FIG. 3, the secondary transfer device 52, the fixing unit 53, the main conveying path 70, and the reverse conveying path 73 that are held on the carrier 71 are not illustrated. In the drawer unit 76 as will be illustrated in the drawings below, the secondary transfer device 52, the fixing unit 53, the main conveying path 70, and the reverse conveying path 73 that are held on the carrier 71 are omitted to be illustrated as appropriate.

As illustrated in FIG. 3, the drawer unit 76 is provided with an electrical substrate 120. The electrical substrate 120 includes a central processing unit (CPU) and a read only memory (ROM). The ROM stores therein control programs and the like for performing control of the secondary transfer device 52, control of the fixing unit 53, paper conveyance control on the main conveying path 70, paper conveyance control on the reverse conveying path 73, paper jam detection control, and the like. In the embodiment, as illustrated in FIG. 3, the electrical substrate 120 and the apparatus main body are connected by using a wire bundle 105 as an electric wire, so that electric connection is kept therebetween even in the state where the drawer unit 76 has been drawn out. In this manner, because the drawer unit 76 is provided with the electrical substrate 120 for controlling the devices held on the carrier 71, only the wire bundle 105 connecting the electrical substrate 120 and the apparatus main body is needed as a wire bundle for connection, which ensures a wire bundle passage easily.

Figure 4:
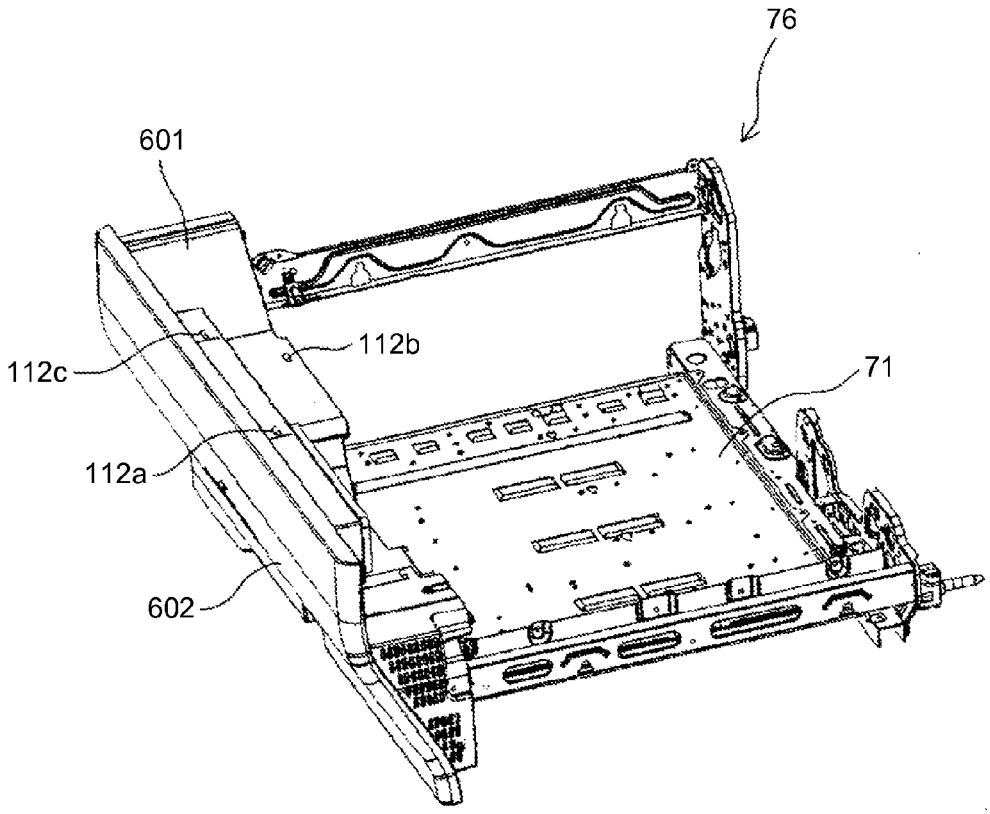
FIG. 4 is a perspective view illustrating the drawer unit.

FIG. 4 is a perspective view illustrating the drawer unit 76.

As illustrated in FIG. 4, the front cover 6 includes an outer cover part 602 and an inner cover part 601. The outer cover part 602 is exposed from the apparatus even when the drawer unit 76 is closed to the apparatus main body. The inner cover part 601 is exposed when the drawer unit 76 is drawn out from the apparatus main body part 5. A plurality of drawer unit LEDs 112*a* to 112*c* are provided on the upper surface of the inner cover part 601. The drawer unit LEDs 112*a* to 112*c* serve as notification units for notifying the occurrence places of paper jam.

When the paper jam is detected on the secondary transfer device 52, the fixing unit 53, the main conveying path 70, the discharging path 60, or the reverse conveying path 73 held on the drawer unit 76, the drawer unit LED 112*a*, 112*b*, or 112*c* corresponding to an occurrence place of the paper jam emits light. In the embodiment, even when the drawer unit 76 is drawn out from the apparatus main body as illustrated in FIG. 3, the drawer unit 76 is electrically connected thereto with the wire bundle 105. With this, even when the user draws out the drawer unit 76 for jam processing, the drawer unit LED 112*a*, 112*b*, or 112*c* corresponding to the occurrence place of the paper jam can be made to emit light. The respective drawer unit LEDs 112*a* to 112*c* are arranged at places corresponding to the occurrence places of the paper jam. For example, the first drawer unit LED 112*a* is provided at a position corresponding to an operating member (not illustrated) that is operated for removing paper jammed in the conveying path from the paper feeding unit 3 to the secondary transfer nip in the drawer unit 76. The second drawer unit LED 112*b* is provided at a position corresponding to an operating member (not illustrated) that is operated for removing paper jammed in the conveying path from the secondary transfer nip to the fixing unit 53. The third drawer unit LED 112*c* is provided at a position corresponding to an operating member (not illustrated) that is operated for removing paper jammed in the discharging path 60 from the fixing unit 53 to the discharge tray 61. Although not illustrated in the FIG. 4, a drawer unit LED is also provided at a place corresponding to an operating member (not illustrated) that is operated for removing paper jammed in the reverse conveying path 73 and is provided on the front surface of the outer cover part 602.

Figure 5:
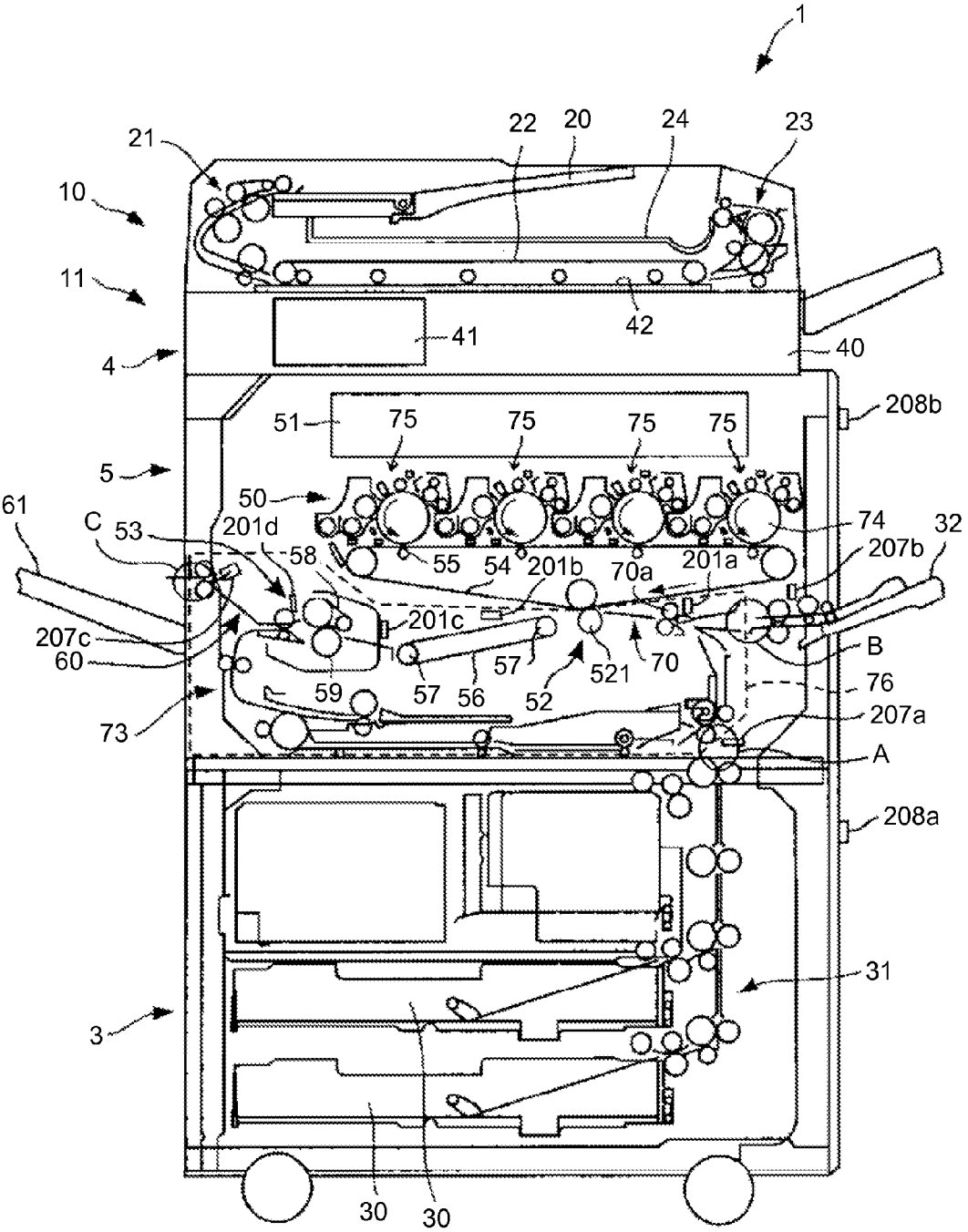
FIG. 5 is a view illustrating an example of arrangement positions of paper detecting sensors.

FIG. 5 is a view illustrating an example of arrangement positions of paper detecting sensors serving as paper jam detecting units.

As illustrated in FIG. 5, provided are a pre-secondary transfer paper-detecting sensor 201*a* and a post-secondary transfer paper-detecting sensor 201*b*. The pre-secondary transfer paper-detecting sensor 201*a* detects paper passing through the pair of registration rollers 70*a*. The post-secondary transfer paper-detecting sensor 201*b* detects paper passing through the paper carriage belt 56. Furthermore, provided are a pre-fixing paper-detecting sensor 201*c* and a post-fixing paper-detecting sensor 201*d*. The pre-fixing paper-detecting sensor 201*c* is arranged before the fixing unit 53 and detects paper that is conveyed to the fixing unit 53. The post-fixing paper-detecting sensor 201*d* is arranged after the fixing unit 53 and detects paper that has passed through the fixing unit 53.

For example, when the pre-secondary transfer paper-detecting sensor 201*a* detects the paper at the time of occurrence of the paper jam, the first drawer unit LED 112*a* is made to light up. When the post-secondary transfer paper-detecting sensor 201*b* or the pre-fixing paper-detecting sensor 201*c* detects the paper at the time of occurrence of the paper jam, the second drawer unit LED 112*b* is made to light up. When the post-fixing paper-detecting sensor 201*d* detects the paper at the time of occurrence of the paper jam, the third drawer unit LED 112*c* is made to light up.

With this, a user can easily determine the operating member to be operated for performing jam processing based on the drawer unit LED that lights up, thereby performing the accurate jam processing. When the user has removed the jammed paper and the paper detecting sensor no longer detects the paper, the corresponding drawer unit LED is made to light off. Then, when the user visually checks that all the drawer unit LEDs light off, the user returns the drawer unit 76 to the apparatus main body and finishes the jam processing. This can prevent the user from failing to perform the jam processing.

It is preferable that the drawer unit 76 can be drawn out to the extent of equal to or longer than the length of the apparatus main body in the draw-out direction of the drawer unit. With this configuration, the secondary transfer device 52, the fixing unit 53, the main conveying path 70, the discharging path 60, and the reverse conveying path 73 held on the drawer unit 76 can be drawn out from the apparatus main body completely. This makes it possible to perform the jam processing easily.

The drawer unit LEDs 112*a* to 112*c* serving as the notification units are desirably arranged at places at which they are easy to be checked visually from the front side in the state where the drawer unit 76 is opened. In the embodiment, the drawer unit LEDs 112*a* to 112*c* are installed on the upper surface of the inner cover part 601 of the front cover 6 because the upper surface of the inner cover part 601 is considered to be easily checked visually when the drawer unit 76 is drawn out from the apparatus main body.

When the paper jam occurs and the conveyance of the paper is stopped, the paper stops in a state of straddling the conveying path in the drawer unit 76 and the conveying path other than that in the drawer unit in some cases. In the embodiment, as illustrated in FIG. 5, there is a paper-feeding path straddle portion A on which the paper straddles the paths when the paper is conveyed to the drawer unit from the paper feeding unit 3. There is also a bypass path straddle portion B on which the paper straddles the paths when the paper is conveyed to the drawer unit from the bypass tray 32. Furthermore, there is a discharge path straddle portion C on which the paper straddles the paths when the paper is conveyed to the discharge tray 61 from the drawer unit 76.

Figure 6:
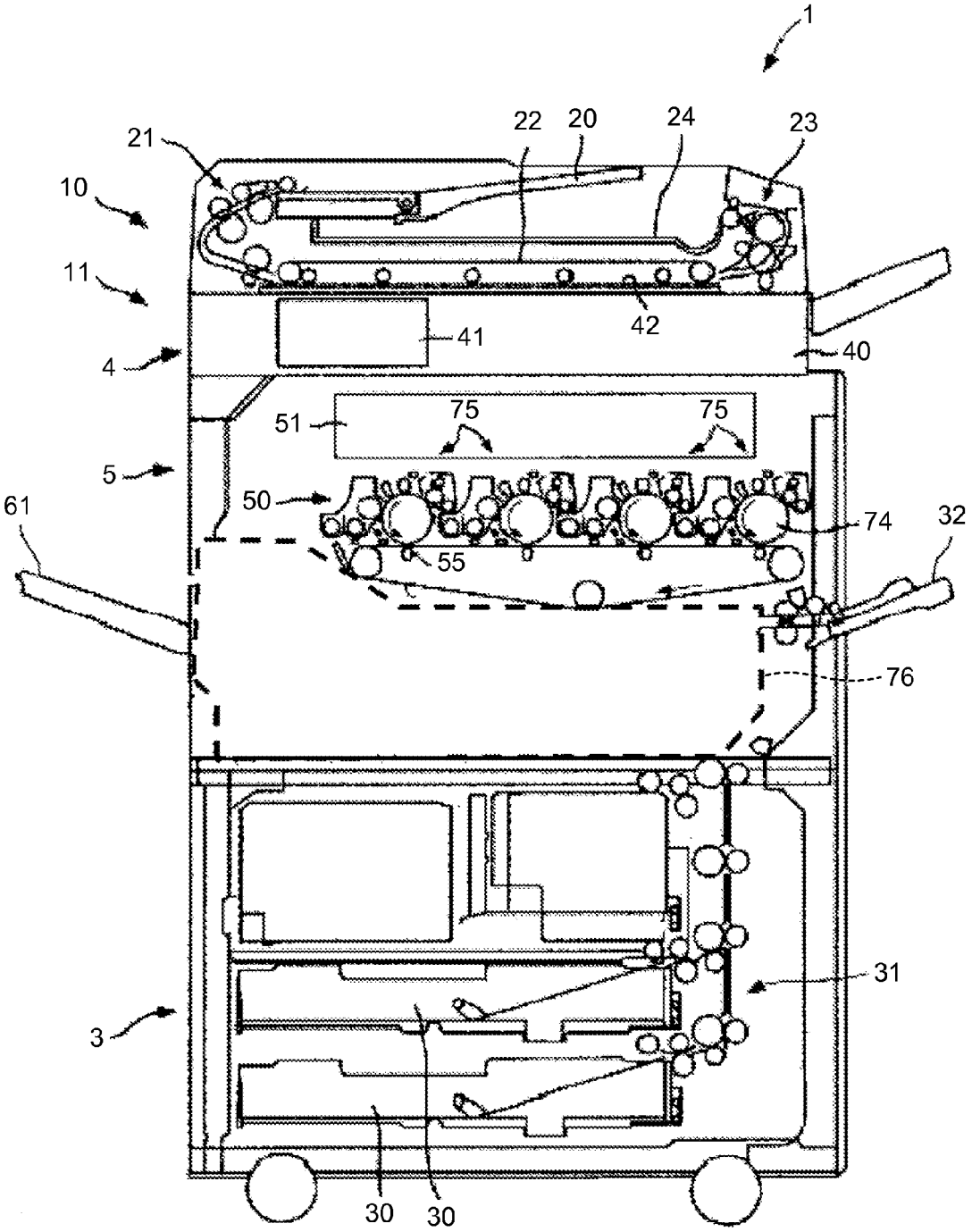
FIG. 6 is a schematic configuration view illustrating the image forming apparatus in the state where the drawer unit has been drawn out.

FIG. 6 is a schematic configuration view illustrating the image forming apparatus 1 when the drawer unit 76 has been drawn out. As illustrated in FIG. 6, when the drawer unit 76 is drawn out, the paper feeding unit 3, the bypass tray 32, and the discharge tray 61 are located in the apparatus main body.

At the time of the jam processing, when the drawer unit 76 is drawn out in the state where the paper straddles on any of these straddle portions, a portion of the paper located in the drawer unit 76 is moved to the apparatus main body part side while being wrinkled. Furthermore, a portion of the paper located in the apparatus main body part 5 or the paper feeding unit 3 is moved in the draw-out direction of the drawer unit 76 while being wrinkled. Then, when the drawer unit 76 is drawn out from the apparatus main body completely, so-called paper tearing that the paper is split and ripped occurs. The paper in the drawer unit 76 drawn out from the apparatus main body part 5 that has been moved to the apparatus main body part side and has been ripped enters spaces and the like in the drawer unit 76 in the apparatus main body complicatedly, and so on. Due to this, a removal operation of the paper becomes difficult. In the same manner, the paper in the apparatus main body part 5 or the paper feeding unit 3 that has been moved in the draw-out direction and has been ripped also enters spaces and the like in the apparatus main body or the paper feeding unit at the draw-out direction side complicatedly, and so on. Also due to this, the removal operation of the paper becomes difficult. Thus, when the user tries to forcibly remove the paper in the drawer unit 76 or the apparatus main body part 5 or the paper feeding unit 3 that has been moved to one direction side while being wrinkled and has entered the spaces and the like complicatedly, the paper is ripped and paper pieces are left in the drawer unit 76 or the apparatus main body part 5 (paper feeding unit 3) in some cases. As a result, the paper pieces are bitten by the carriage roller provided on the drawer unit 76, the carriage roller provided on the apparatus main body part or the paper feeding unit, or the like, resulting in conveyance failure in some cases. Furthermore, when the paper pieces remain on the paper detecting sensors provided on the drawer unit 76 and the like, there is a risk that paper jam detection cannot be performed preferably.

In order to solve this problem, in the embodiment, in the state where the paper straddles on any of the above-mentioned straddle portions at the time of the jam processing, the drawer unit 76 is made to be incapable of being drawn out from the apparatus main body. This can cause the drawer unit 76 to be drawn out from the apparatus main body after the straddling paper is removed.

As illustrated in FIG. 5, in the embodiment, a paper-feeding conveyance sensor 207*a* is provided as a straddle detecting unit in the vicinity of the paper-feeding path straddle portion A. The paper-feeding conveyance sensor 207*a* detects straddle of the paper on the paper-feeding path straddle portion A. Provided is a bypass paper-feeding sensor 207*b* serving as a straddle detecting unit in the vicinity of the bypass path straddle portion B. The bypass paper-feeding sensor 207*b* detects straddle of the paper on the bypass path straddle portion B. Also provided is a discharge sensor 207*c* as a straddle detecting unit in the vicinity of the discharge path straddle portion C. The discharge sensor 207*c* detects straddle of the paper on the discharge path straddle portion C. The paper-feeding conveyance sensor 207*a* and the bypass paper-feeding sensor 207*b* are installed on the apparatus main body part 5 and the discharge sensor 207*c* is installed on the drawer unit 76. Hereinafter, when the paper-feeding conveyance sensor 207*a*, the bypass paper-feeding sensor 207*b*, and the discharge sensor 207*c* as described above that detect straddle of the paper are not distinguished from one another, each of them is referred to as a straddle sensor 207 collectively. When any of these straddle sensors 207 detects the paper jam, the drawer unit 76 is locked to the apparatus main body by a lock mechanism, which will be described later.

As illustrated in FIG. 5, an upper right cover LED 208*b* is provided as a notification unit on a right side cover member of the apparatus main body part. Furthermore, a lower right cover LED 208*a* is provided on a right side cover member of the paper feeding unit 3. These cover LEDs 208*a* and 208*b* also notify the user of places to be operated when the user performs the jam processing.

Figure 7:
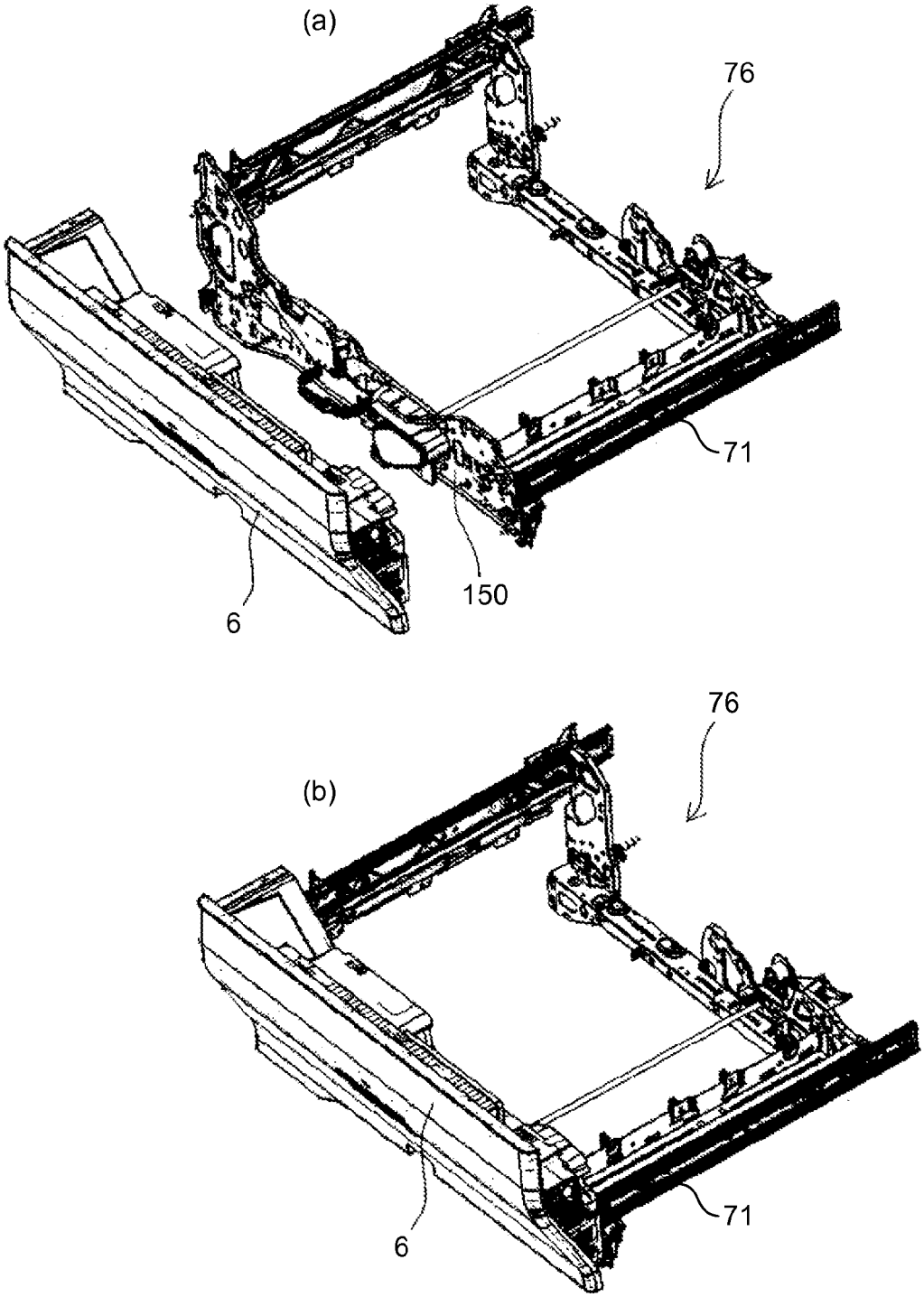
FIG. 7(*a*) is an exploded perspective view illustrating a carrier of the drawer unit and a front cover, and FIG. 7(*b*) is a perspective view illustrating a state where the front cover is fixed to the carrier of the drawer unit.

FIG. 7(*a*) is an exploded perspective view illustrating the carrier 71 of the drawer unit 76 and the front cover 6 and FIG. 7(*b*) is a perspective view illustrating a state where the front cover 6 is fixed to the carrier 71 of the drawer unit 76.

Figure 8:
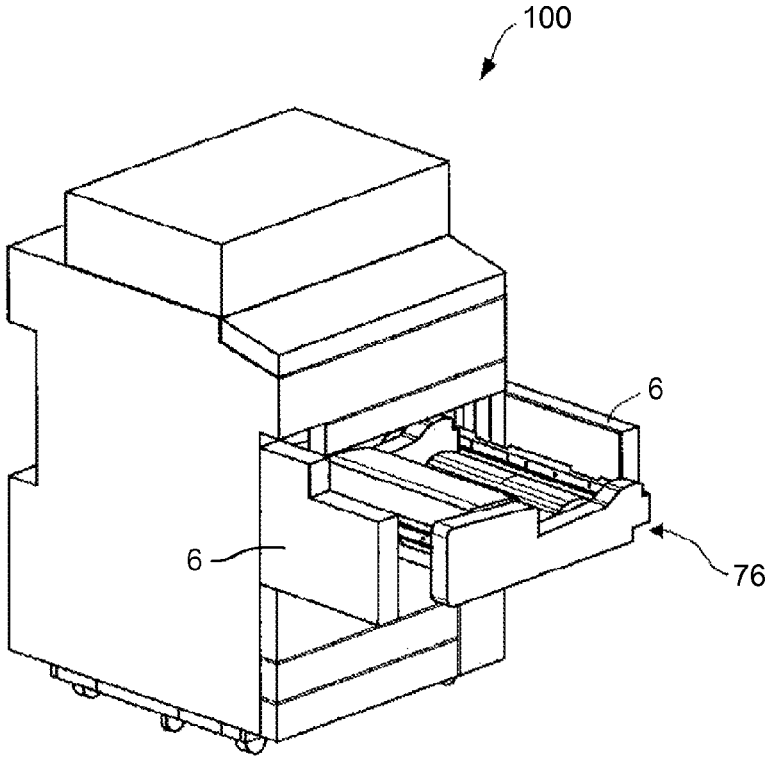
FIG. 8 is a perspective view illustrating an image forming apparatus in which front covers are configured as separate members from the drawer unit.

The front cover 6 is fastened to a drawer unit front side plate 150 by screws and is not detached therefrom without using a tool. Thus, in the embodiment, the front cover 6 is fixed to the drawer unit 76, so that the drawer unit 76 can be drawn out only by drawing out the front cover 6. This makes it possible to perform the operation of drawing out the drawer unit 76 by one action. Furthermore, an operation efficiency of the jam processing can be enhanced in comparison with a configuration of the image forming apparatus 100 in which the front covers 6 are opened, and then, the drawer unit 76 is drawn out as illustrated in FIG. 8.

Figure 9:
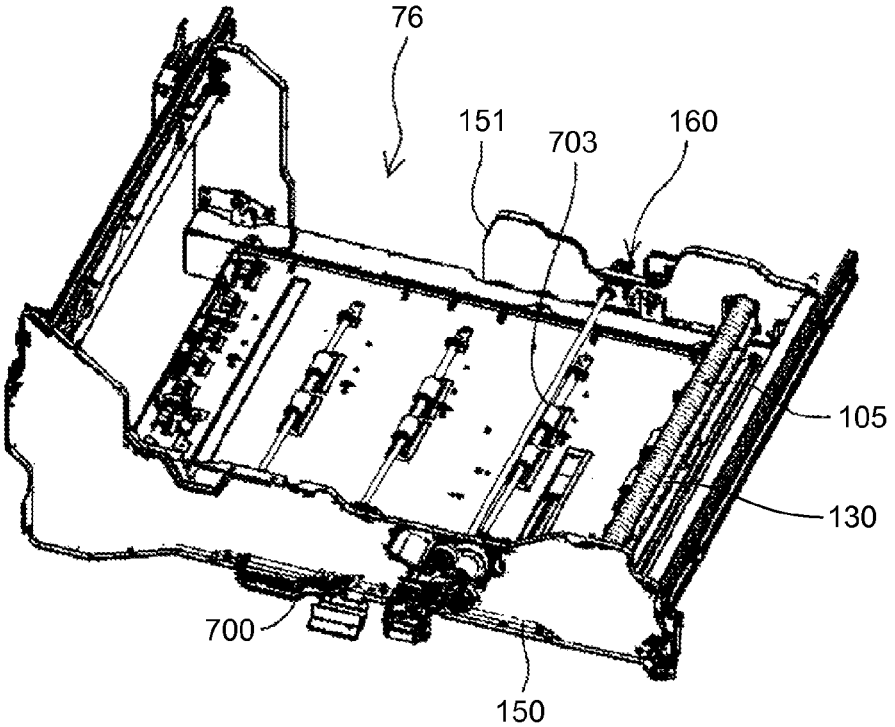
FIG. 9 is a perspective view illustrating the drawer unit from which the front cover has been detached.

FIG. 9 is a perspective view illustrating the drawer unit 76 from which the front cover 6 has been detached.

FIG. 9 illustrates a state where the drawer unit is accommodated in the apparatus main body part.

As illustrated in FIG. 9, the drawer unit 76 is provided with the wire bundle 105 at its right end portion in FIG. 9 (end portion at the main conveying path 70 side) and a cord guide 130 holds the wire bundle 105. The wire bundle 105 is so-called a curl cord obtained by winding a cord in a spiral manner. The wire bundle 105 is formed by the curl cord, so that the wire bundle 105 is freely extendable in the draw-out direction. This can prevent deflection of the wire bundle 105 in comparison with the case where the wire bundle 105 is formed by a non-extendable cord. With this, the wire bundle 105 can be prevented from protruding from the drawer unit 76 and deflecting when seen from the draw-out direction of the drawer unit 76, thereby preventing the wire bundle 105 from being caught by parts in the apparatus main body. The cord guide 130 is attached to a main body rear side plate 501 (see FIG. 15) of the apparatus main body part 5, which will be described later. As illustrated in FIG. 9, the cord guide 130 is accommodated in the drawer unit 76 in the state where the drawer unit is accommodated in the apparatus main body part 5. When the drawer unit 76 is drawn out from the apparatus main body, the cord guide 130 is drawn out from the drawer unit 76 together with the wire bundle 105 relatively from the drawer unit rear side plate 151. With this, the wire bundle 105 relatively drawn out from the drawer unit 76 is guided by the cord guide 130, thereby preventing the wire bundle 105 from deflecting (see, FIG. 15).

A lock shaft 703 is supported on the drawer unit front side plate 150 and the drawer unit rear side plate 151 in a rotatable manner. A lock mechanism 160 serving as a lock unit is provided on a rear end portion of the lock shaft 703.

Figure 10:
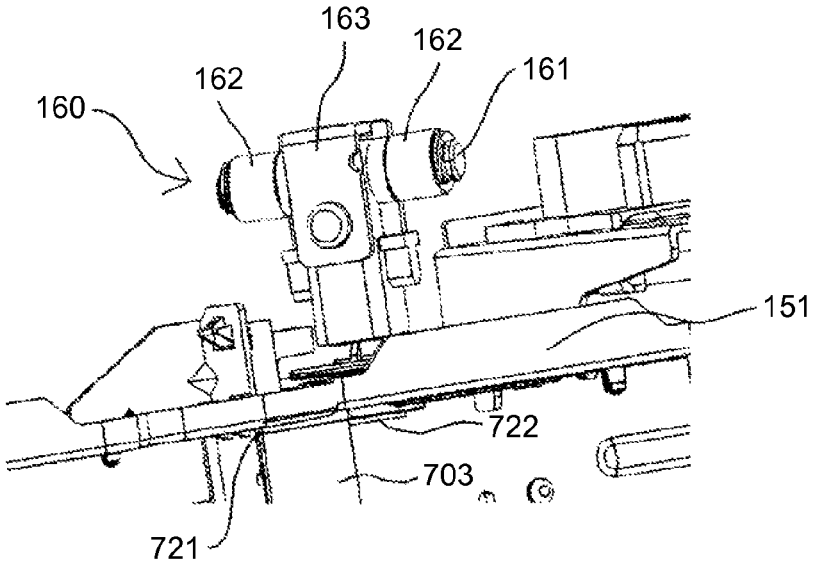
FIG. 10 is a perspective view illustrating a configuration of a lock mechanism.

FIG. 10 is a perspective view illustrating a configuration of the lock mechanism 160.

As illustrated in FIG. 10, the rear end portion of the lock shaft 703 projects from the drawer unit rear side plate 151 and the lock mechanism 160 is attached to the end portion thereof. The lock mechanism 160 includes a fitting member 163 having a prismatic shape that is fixed to the lock shaft 703. The lock mechanism 160 includes a roller shaft 161. The roller shaft 161 is fixed to the fitting member 163 so as to penetrate through the fitting member 163 in the direction orthogonal to the axial direction of the lock shaft 703. Provided are rotating rollers 162 in the vicinity of both end portions of the roller shaft 161. The rotating rollers 162 are attached to the roller shaft 161 in a rotationally movable manner.

As illustrated in FIG. 10, the lock shaft 703 is attached to the drawer unit rear side plate 151 through a sintered bearing 721. An E ring 722 is fixed to a groove provided on the lock shaft 703 so as to make contact with the front surface of the drawer unit rear side plate 151.

As illustrated in FIG. 9, a driving unit 700 provided on the drawer unit front side plate 150 through the lock shaft 703. The driving unit 700 drives the lock mechanism 160 rotationally.

Figure 11:
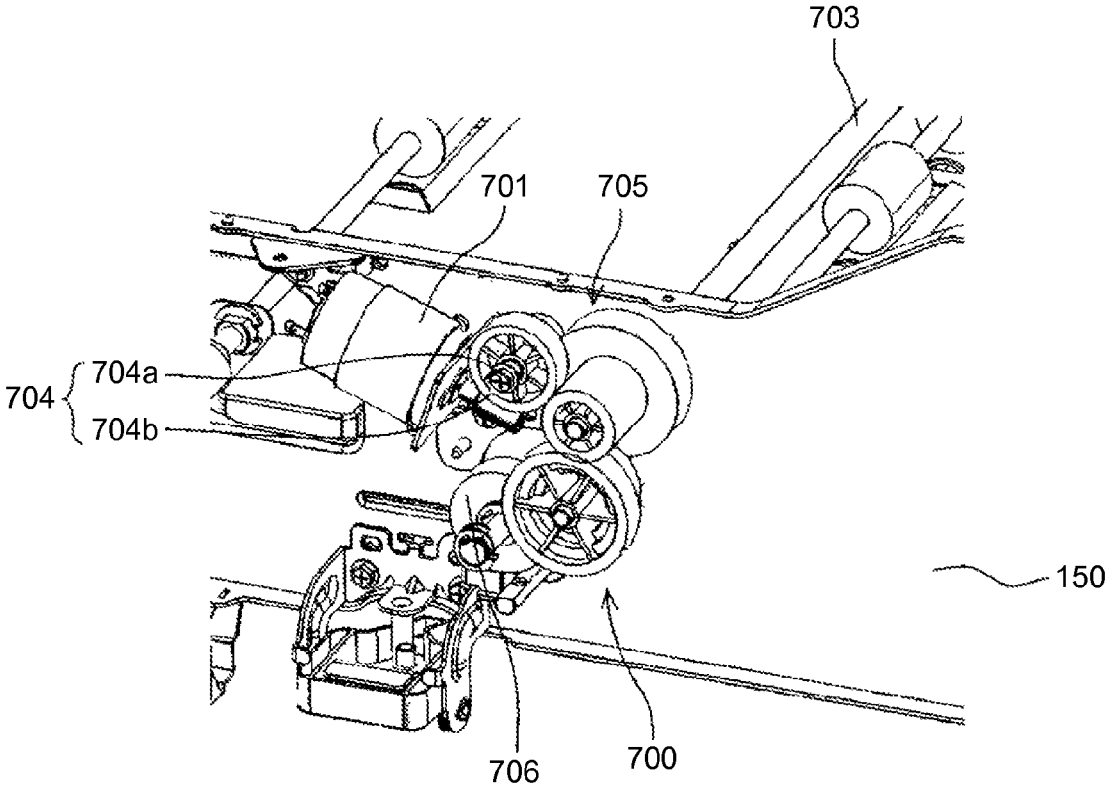
FIG. 11 is a perspective view illustrating a configuration of a driving unit.

FIG. 11 is a perspective view illustrating a configuration of the driving unit 700.

As illustrated in FIG. 11, the driving unit 700 includes a driving motor 701. The driving motor 701 is fixed to the drawer unit front side plate 150 such that the motor shaft thereof is parallel with the drawer unit front side plate 150. By fixing the driving motor 701 in this manner, an increase in the size of the drawer unit 76 in the draw-out direction can be suppressed in comparison with the case where the driving motor 701 is fixed such that the motor shaft thereof is orthogonal to the drawer unit front side plate 150.

A worm 704*a* of a worm gear 704 is fixed to the motor shaft of the driving motor 701. A driving force of the driving motor 701 is transmitted to a driven gear 706 fixed to the lock shaft 703 from a worm wheel 704*b* of the worm gear 704 through a gear train 705. Note that the worm wheel 704*b* is engaged with the worm 704*a* and a plurality of idler gears constitutes the gear train 705. With this mechanism, the lock shaft 703 is driven rotationally.

Figure 12:
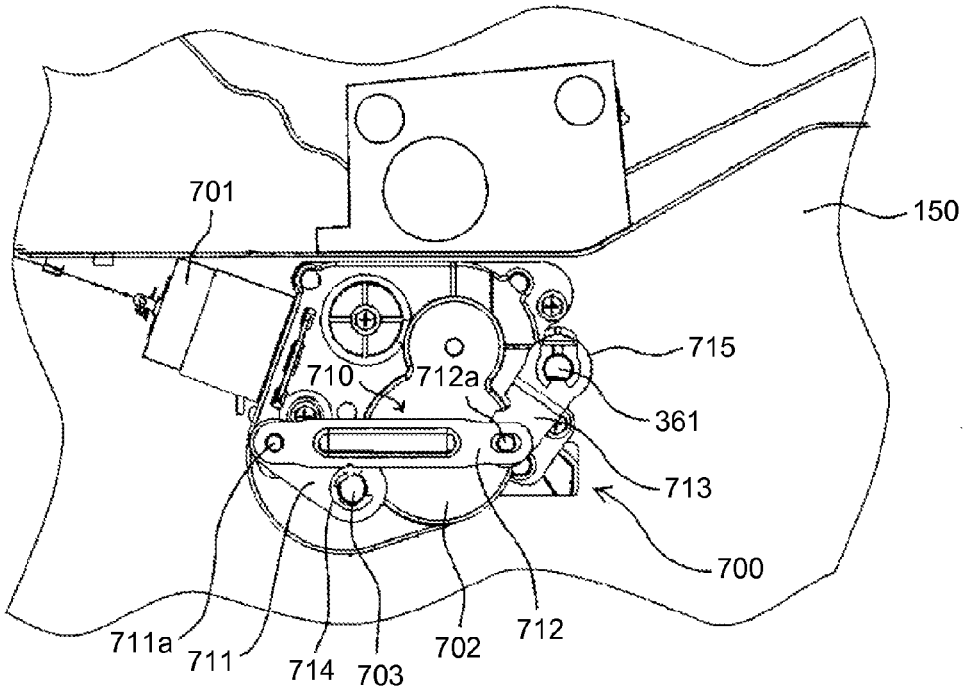
FIG. 12 is a front view illustrating the driving unit.

FIG. 12 is a front view illustrating the driving unit 700.

As illustrated in FIG. 12, a case 702 accommodates the worm gear 704, the plurality of idler gears constituting the gear train 705, and the driven gear 706 fixed to the lock shaft 703.

A link mechanism 710 is connected to the front end portion of the lock shaft 703. The link mechanism 710 transmits driving to contact/separation mechanisms, which will be described later, that cause the secondary transfer roller 521 to make contact with and be separated from the intermediate transfer belt 54.

The link mechanism 710 includes an output link member 711, a coupling link member 712, and an input link member 713. One end of the output link member 711 is fixed to the lock shaft 703 and the other end thereof includes an output protrusion 711*a*. The front end portion of the lock shaft 703 has a cross section of a D shape. A fitting hole having a D shape is formed on one end of the output link member 711. The front end portion of the lock shaft 703 is fitted into the fitting hole. An E ring 714 is attached to the lock shaft 703 such that the output link member 711 is disengaged from the lock shaft 703. With this, the output link member 711 is fixed to the lock shaft 703.

One end of the coupling link member 712 is attached to the output protrusion 711*a* of the output link member 711 in a rotationally movable manner. A long hole 712*a* is formed on the other end of the coupling link member 712. An input protrusion 713*a* provided on one end of the input link member 713 is fitted into the long hole 712*a*. Furthermore, an end portion of an input shaft 361 that inputs a driving force to the contact/separation mechanisms, which will be described later, is also formed to have a cross section of a D shape. A fitting hole having a D shape is formed on the other end of the input link member 713. One end of the input shaft 361 is fitted into the fitting hole. Then, the E ring 715 is attached to the input shaft 361 such that the input link member 713 is not disengaged from the input shaft 361.

A plate material can be used as each link member by using the link mechanism 710 for transmitting driving to the input shaft 361 from the lock shaft 703. This makes it possible to suppress an increase in the size of the drawer unit 76 in the draw-out direction in comparison with the case where driving is transmitted with the gear.

Described is the contact/separation mechanism that causes the secondary transfer roller 521 to make contact with and be separated from the intermediate transfer belt 54. The contact/separation mechanisms are provided at both ends (front side and rear side) of the secondary transfer roller in the axial direction and have the same configuration.

Figure 13:
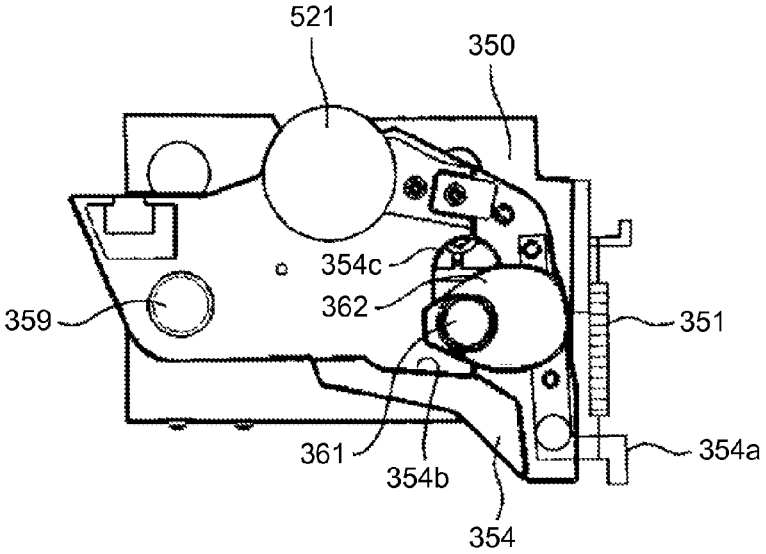
FIG. 13 is a schematic configuration view illustrating a secondary transfer roller contact/separation mechanism.

FIG. 13 is a schematic configuration view illustrating the contact/separation mechanism provided on the secondary transfer roller 521 at one end side in the axial direction.

The secondary transfer roller 521 is supported on a holding member 354 in a rotatable manner. The holding member 354 is supported on a support shaft 359 attached to a frame 350 of the secondary transfer device in a rotatable manner. A spring bearing 354*a* is provided on the holding member 354 at an end portion at the side opposite to the support shaft 359 side with the secondary transfer roller 521 interposed therebetween. One end of a spring 351 is attached to the spring bearing 354*a* and the spring 351 biases the holding member 354 upward in FIG. 13 (to the intermediate transfer belt 54 side). A long hole 354*c* is provided on the holding member 354 at the side opposite to the support shaft 359 side with the secondary transfer roller 521 interposed therebetween. The above-mentioned input shaft 361 penetrates through the long hole 354*c*. A release cam 362 is attached to the input shaft 361. The holding member 354 is provided with an abutment part 354*b* against which the release cam 362 abuts.

Figure 14:
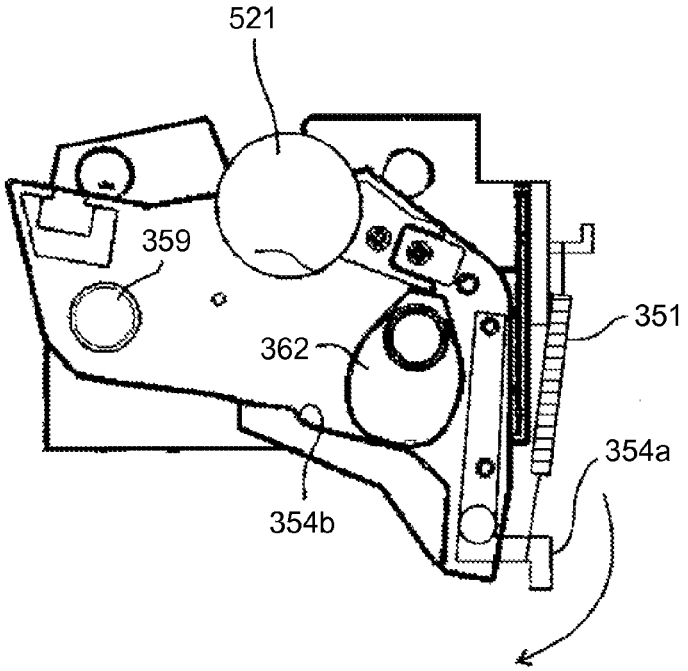
FIG. 14 is a view illustrating a state where a secondary transfer roller is located at a separated position.

As illustrated in FIG. 13, when the release cam 362 is in a state of being separated from the abutment part 354*b*, the secondary transfer roller 521 abuts against the intermediate transfer belt 54 at a predetermined pressure by the biasing force of the spring 351. When the drawer unit 76 is drawn out, the input shaft 361 is moved rotationally and the release cam 362 is moved rotationally in the clockwise direction in FIG. 13. Then, the release cam 362 abuts against the abutment part 354*b*. When the input shaft 361 is further moved rotationally, as illustrated in FIG. 14, the holding member 354 is moved rotationally in the clockwise direction in the FIG. 14 about the support shaft 359 as a fulcrum against the biasing force of the spring 351 by the release cam 362. With this, the secondary transfer roller 521 is separated from the intermediate transfer belt 54. That is to say, in the embodiment, the holding member 354, the spring 351, the release cam 362, and the like configure the contact/separation mechanism that causes the secondary transfer roller 521 to make contact with and be separated from the intermediate transfer belt 54.

In the embodiment, the secondary transfer roller 521 is configured to be moved to a retreat position as illustrated in FIG. 14 from a pressurized position as illustrated in FIG. 13 by approximately 5 to 7 mm.

Figure 15:
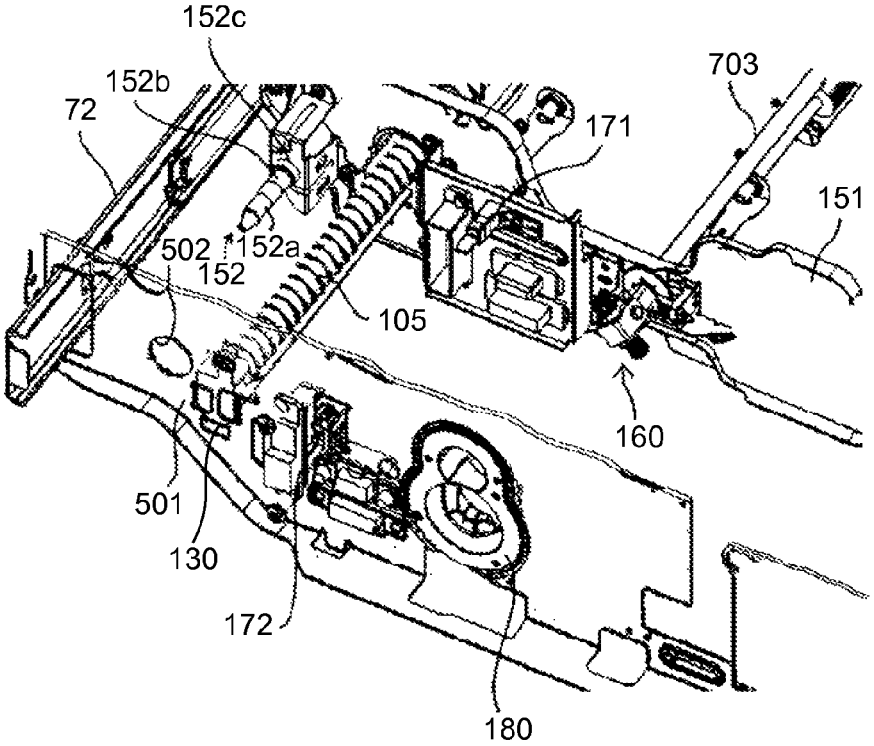
FIG. 15 is a perspective view illustrating the rear side of an apparatus main body part in a state where the drawer unit has been drawn out.
Figure 16:
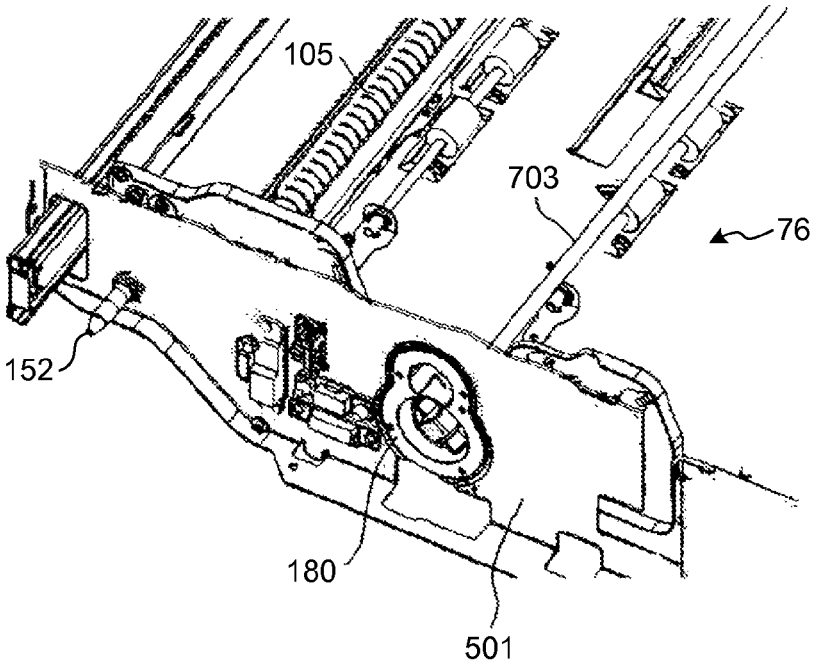
FIG. 16 is a perspective view illustrating the rear side of the apparatus main body part in a state where the drawer unit has been set to the apparatus main body part.

FIG. 15 is a perspective view illustrating the rear side of the apparatus main body part in a state where the drawer unit 76 has been drawn out. FIG. 16 is a perspective view illustrating the rear side of the apparatus main body part in a state where the drawer unit 76 has been set to the apparatus main body part 5.

A positioning hole 502 is provided on the main body rear side plate 501 of the apparatus main body part 5 in the vicinity of the left end portion in FIG. 15. A positioning pin 152 provided on the drawer unit 76 at the left end portion in FIG. 15 is inserted into the positioning hole 502. The positioning pin 152 includes a fitting part 152*b* and a guide part 152*a* having a tapered shape. The fitting part 152*b* is fitted into the positioning hole 502. The guide part 152*a* is a part for guiding the fitting part 152*b* to the positioning hole. Furthermore, the positioning pin 152 includes a seat part 152*c* having a diameter larger than that of the fitting part 152*b*. The seat part 152*c* is pressed against the main body rear side plate 501 when the lock mechanism 160 locks the drawer unit to the apparatus main body part 5 as will be described later.

The main body rear side plate 501 is provided with a set detecting sensor 172 for detecting that the drawer unit 76 is set to the apparatus main body part 5. The drawer unit rear side plate 151 is provided with a filler 171 serving as a set detection target part that is detected by the set detecting sensor 172. That is to say, in the embodiment, the set detecting sensor 172, the filler 171, and the like configure a set detecting mechanism as a set detecting unit that detects setting of the drawer unit 76 to the apparatus main body part 5.

Figure 17:
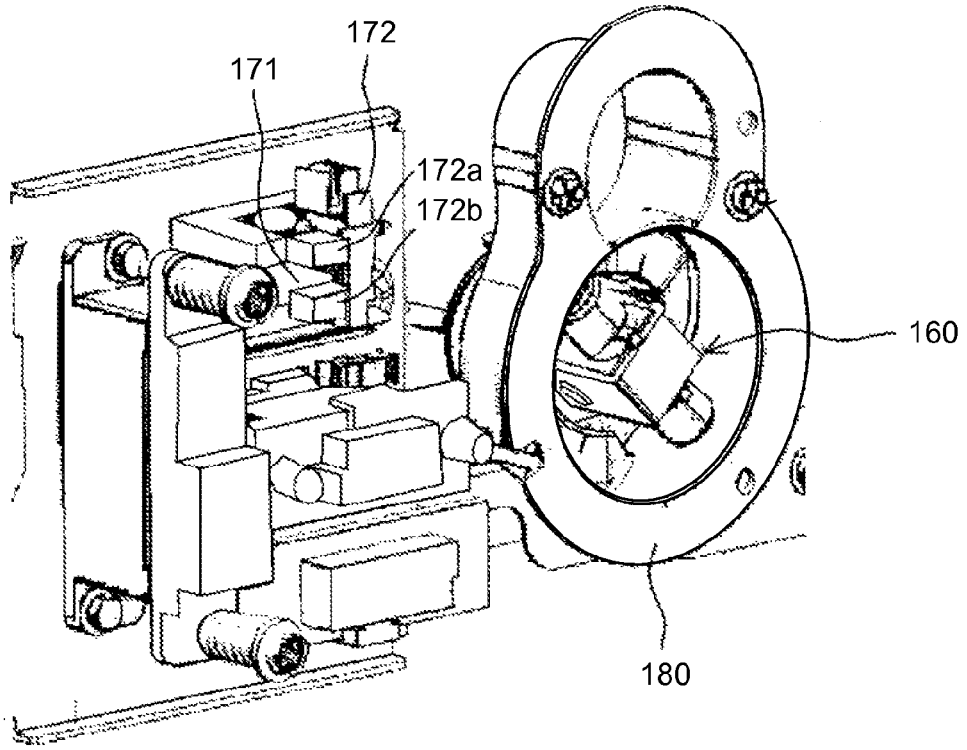
FIG. 17 is an enlarged configuration view illustrating the vicinity of a set detecting sensor.

FIG. 17 is an enlarged configuration view illustrating the vicinity of the set detecting sensor 172.

As illustrated in FIG. 17, a photointerrupter (transparent optical sensor) is used as the set detecting sensor 172. When the drawer unit 76 is set to the apparatus main body part 5, the set detection filler 171 provided on the drawer unit rear side plate 151 enters between a light-receiving part 172*b* and a light-emitting part 172*a* of the set detecting sensor 172 so as to shield light from the light-emitting part 172*a*. With this, the light-receiving part 172*b* does not detect light from the light-emitting part 172*a*, thereby detecting that the drawer unit 76 has been set to the apparatus main body part 5.

As illustrated in FIG. 15 and FIG. 16, a lock receiving member 180 is provided against which the rotating rollers 162 of the above-mentioned lock mechanism 160 are pressed when the drawer unit 76 is locked to the apparatus main body part 5.

Figure 18:
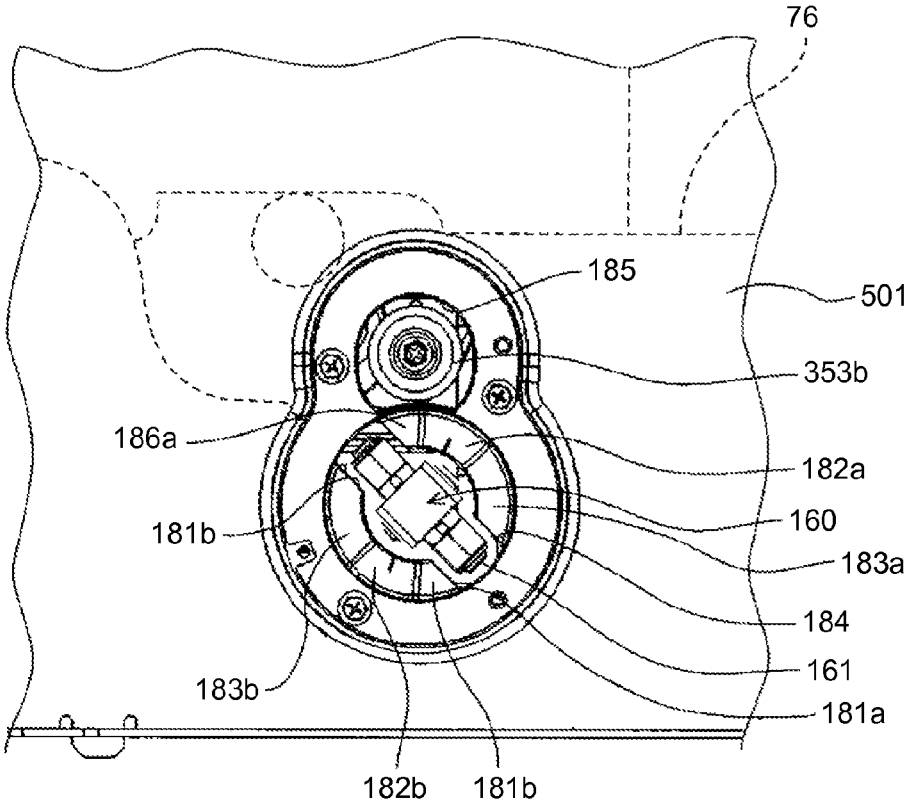
FIG. 18 is an enlarged configuration view illustrating the vicinity of a lock receiving member.
Figure 19:
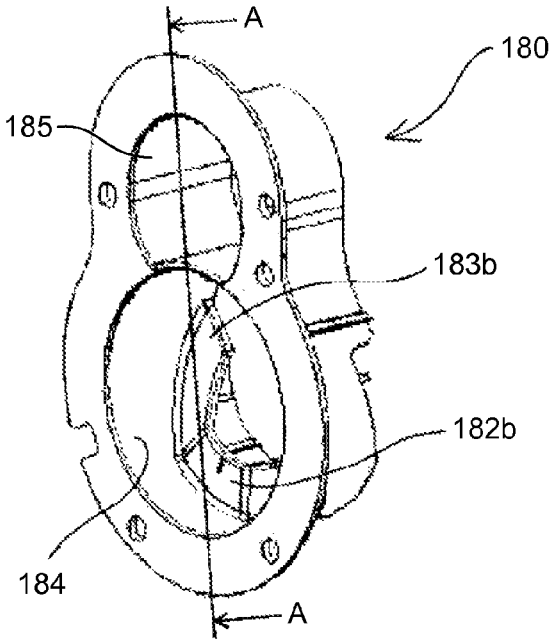
FIG. 19 is a perspective view illustrating the lock receiving member.

FIG. 18 is an enlarged configuration view illustrating the vicinity of the lock receiving member 180. FIG. 19 is a perspective view illustrating the lock receiving member 180.

The lock receiving member 180 is provided with a lock through-hole 184 into which the lock mechanism 160 is inserted. A secondary transfer through-hole 185 is provided at the upper side of the lock through-hole 184. A joint member 353*b* fixed to the shaft of the secondary transfer roller 521 is inserted into the secondary transfer through-hole 185. As illustrated in FIG. 19, the secondary transfer through-hole 185 and the lock through-hole 184 of the lock receiving member 180 have cylindrical shapes.

Figure 20:
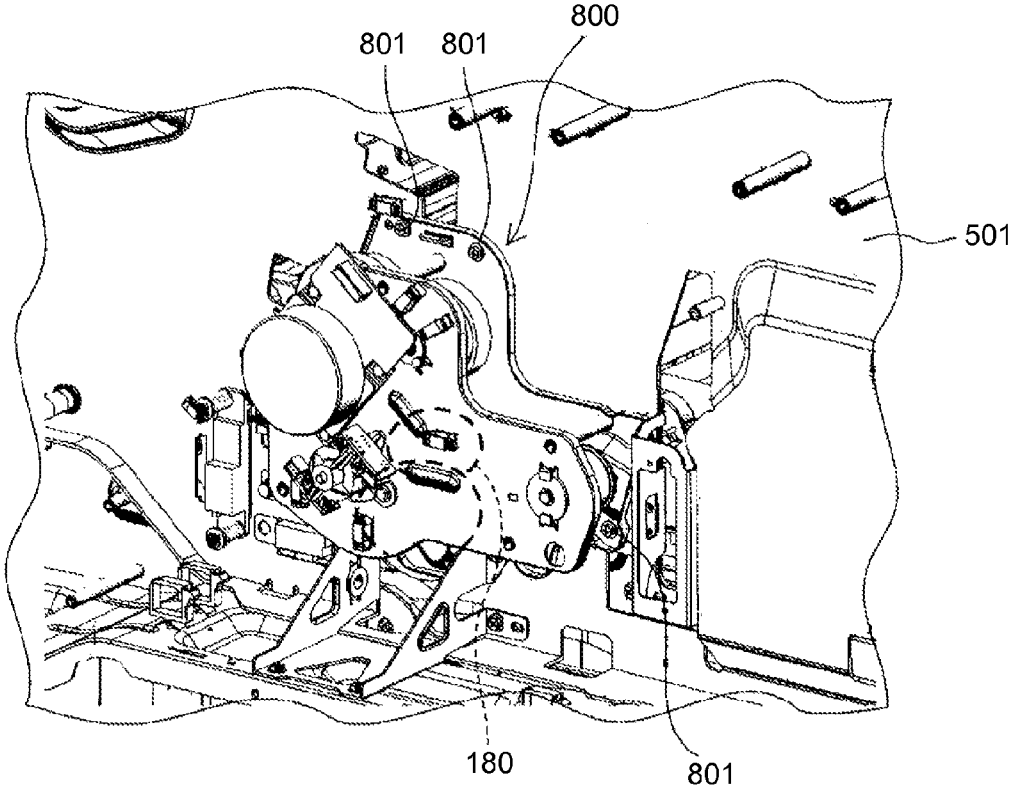
FIG. 20 is a view for explaining an arrangement position of a secondary transfer driving unit.

When the drawer unit 76 is set to the apparatus main body part 5, the above-mentioned joint member 353*b* penetrates through the above-mentioned secondary transfer through-hole 185 so as to be assembled onto a joint member (not illustrated) of a secondary transfer driving unit 800 as illustrated in FIG. 20. With this, the secondary transfer roller 521 is driven rotationally with a driving force of a secondary transfer motor.

As illustrated in FIG. 18, lock receiving surfaces 182*a* and 182*b* serving as lock receiving parts are formed on the inner circumferential surface of the lock through-hole 184. The rotating rollers 162 of the lock mechanism 160 make contact with the lock receiving surfaces 182*a* and 182*b*, so that the drawer unit 76 is locked to the apparatus main body part 5. Furthermore, guide surfaces 183*a* and 183*b* are connected to the end portions of the lock receiving surfaces 182*a* and 182*b* at the clockwise direction side in FIG. 18, respectively. The guide surfaces 183*a* and 183*b* guide the rotating rollers 162 of the lock mechanism 160 to the lock receiving surfaces 182*a* and 182*b*, respectively.

Figure 21:
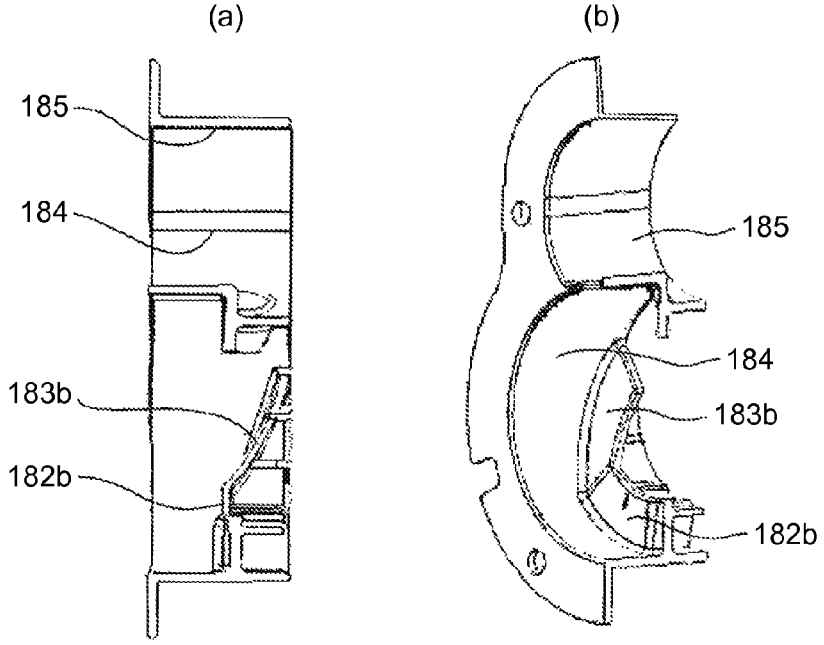
FIGS. 21(*a*) and 21(*b*) are views illustrating the lock receiving member cut along direction A-A in FIG. 19.

FIGS. 21(*a*) and 21(*b*) are views illustrating the lock receiving member cut along direction A-A in FIG. 19. FIG. 21(*a*) is a cross-sectional view illustrating the lock receiving member 180 when seen from the lateral side. FIG. 21(*b*) is a cross-sectional perspective view illustrating the lock receiving member.

As illustrated in FIGS. 21(*a*) and 21(*b*), the respective guide surfaces 183*a* and 183*b* are formed to be tapered surfaces inclined to the drawer unit side (front side) as they are farther from the lock receiving surfaces 182*a* and 182*b*, respectively.

As illustrated in FIG. 18, cutouts 181*a* and 181*b* are formed on the end portions of the guide surfaces 183*a* and 183*b* at the clockwise direction side in FIG. 18, respectively. The rotating rollers 162 of the lock mechanism 160 are inserted into the cutouts 181*a* and 181*b*.

Furthermore, inclined surfaces 186*a* and 186*b* are also formed on the end portions of the lock receiving surfaces 182*a* and 182*b* at the counterclockwise direction side in FIG. 18, respectively. The inclined surfaces 186*a* and 186*b* are inclined to the front side.

Figure 22:
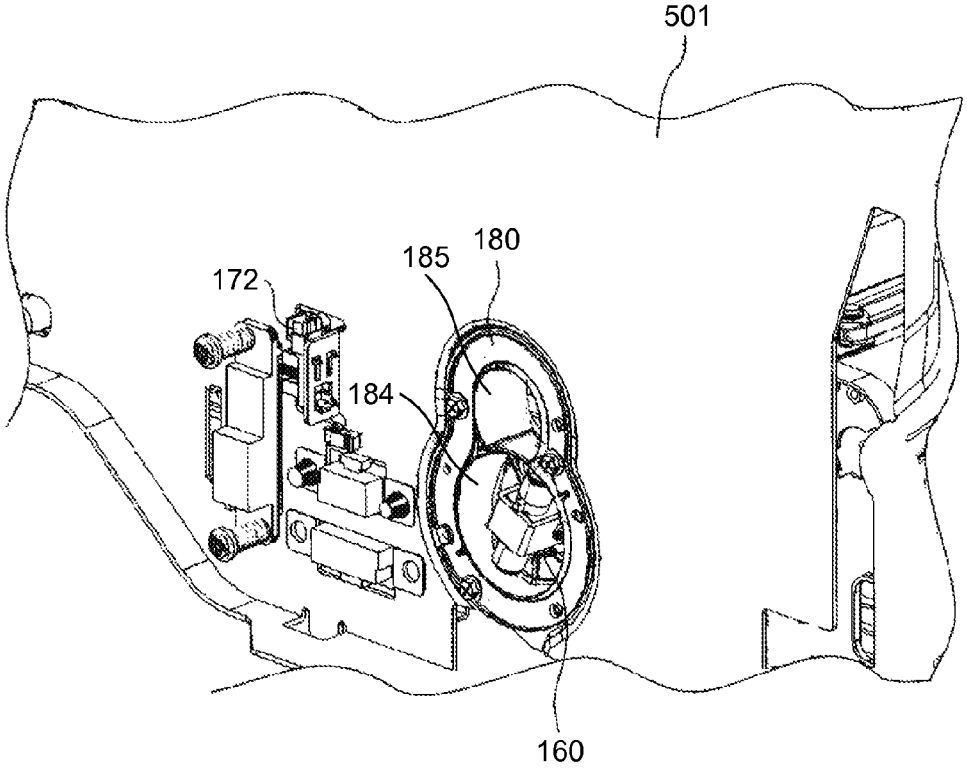
FIG. 22 is a perspective view illustrating a main body rear side plate.

As illustrated in FIG. 22, the cylindrical secondary transfer through-hole 185 and the cylindrical lock through-hole 184 of the lock receiving member 180 project toward the drawer unit 76 relative to the main body rear side plate 501. Thus, the lock receiving member 180 is formed so as not to project from the surface of the main body rear side plate 501 at the side opposite to the drawer unit side. As illustrated in FIG. 20, the secondary transfer driving unit 800 is fastened to the rear surface of the main body rear side plate 501 by screws 801 so as to be opposed to the lock receiving member 180. If the lock receiving member 180 is made to project from the surface of the main body rear side plate 501 at the side opposite to the drawer unit side, the secondary transfer driving unit 800 has to be provided so as to be separated from the rear surface of the main body rear side plate 501 by a projecting amount of the lock receiving member 180. As a result, there is a risk that the size of the apparatus increases in the draw-out direction.

The main body rear side plate 501 is a member for positioning the process cartridges including the photosensitive members, the transfer unit including the intermediate transfer belt 54, the drawer unit 76 accommodating the fixing unit, the secondary transfer device, and the like in the apparatus main body part 5. The main body rear side plate 501 is fixed to the rear side surface of the housing 40 (see FIG. 1) of the image reading unit 4. The main body rear side plate 501 is fixed to the rear side surface of the housing 40 (see FIG. 1) of the image reading unit 4 in this manner, so that the main body rear side plate 501 can be fixed in the apparatus main body part 5 without being inclined in the draw-out direction. This makes it possible to position the process cartridges, the transfer unit, the drawer unit 76, and the like in the apparatus main body part 5 with high accuracy. In general, the length of the image reading unit 4 in the front-rear direction is larger than the length of an image that can be formed by the image forming apparatus in the width direction. On the other hand, the lengths of the drawer unit 76 and the like in the front-rear direction are slightly larger than the length of the image that can be formed by the image forming apparatus in the width direction. This indicates that when the drawer unit 76 is attached to the apparatus main body part 5, a certain amount of space is formed between the drawer unit rear side plate 151 and the main body rear side plate 501. With the space, even when the lock receiving member 180 is made to project to the drawer unit side (front side) with respect to the main body rear side plate 501, the drawer unit rear side plate 151 is not in the way for the lock receiving member 180. The lock receiving member 180 is made to project to the drawer unit side with respect to the main body rear side plate 501, thereby suppressing an increase in the size of the apparatus in the draw-out direction.

Next, described is a lock detecting mechanism serving as a lock detecting unit that detects whether the drawer unit 76 is in a locked state or an unlocked state.

Figure 23:
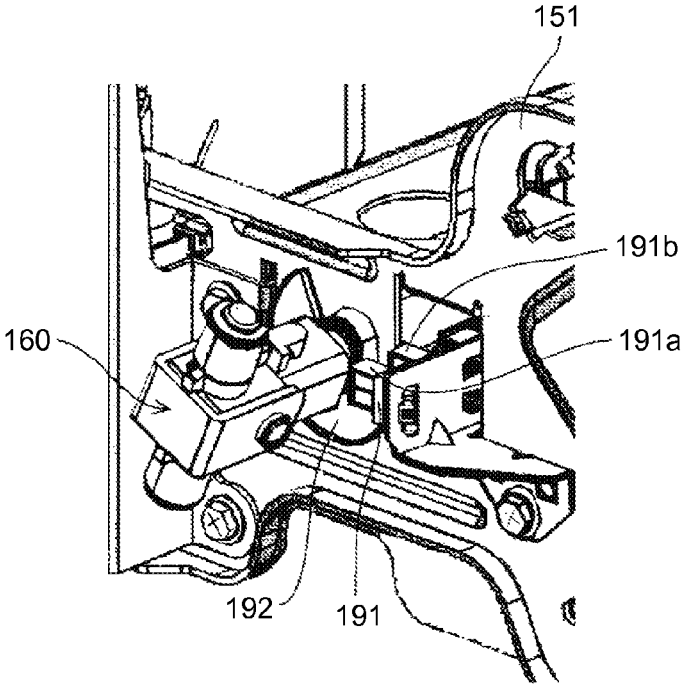
FIG. 23 is a perspective view illustrating a lock detecting mechanism.

FIG. 23 is a perspective view illustrating the lock detecting mechanism.

As illustrated in FIG. 23, the lock detecting mechanism includes a lock detection filler 192 and a lock detecting sensor 191 as a photointerrupter (transparent optical sensor). The lock detection filler 192 is attached to the lock shaft 703 and has a disc shape having a cut-out part. When the drawer unit 76 is in locked state, the lock detection filler 192 enters between a light-receiving part 191*b* and a light-emitting part 191*a* of the lock detecting sensor 191 so as to shield light from the light-emitting part 191*a*. With this, the light-receiving part

191*b* does not detect light from the light-emitting part 191*a*, so that a signal from the light-receiving part 191*b* is "OFF: shielding state". On the other hand, when the lock detection filler 192 is not located between the light-emitting part 191*a* and the light-receiving part 191*b*, the light-receiving part 191*b* receives light from the light-emitting part 191*a*. With this, the signal from the light-receiving part 191*b* is "ON: non-shielding state". A control unit 121 (see FIG. 24) determines whether the drawer unit 76 is in the locked state or the unlocked state based on the ON/OFF signal from the light-receiving part 191*b*.

Figure 24:
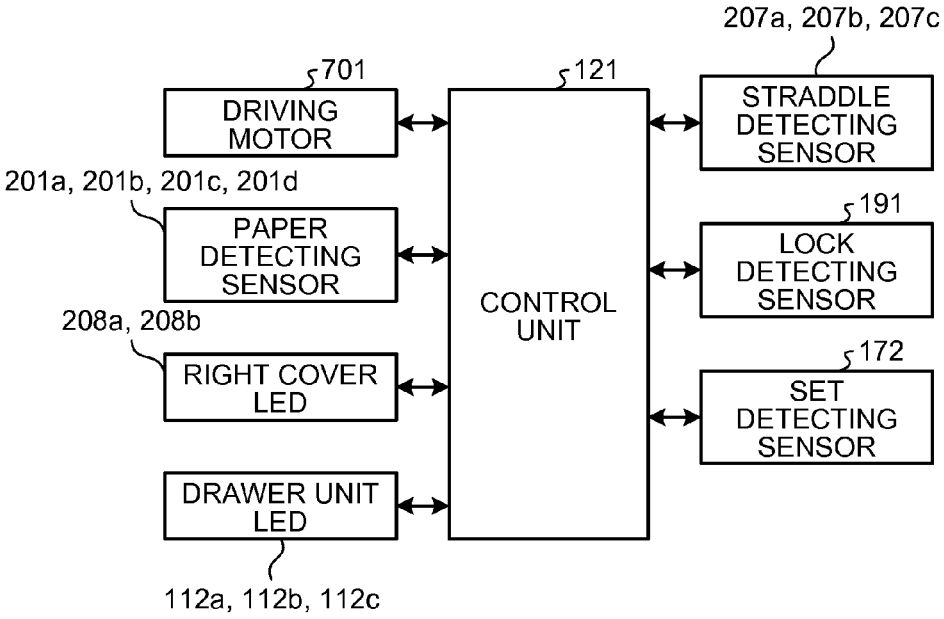
FIG. 24 is a functional block diagram illustrating an example of a configuration of a main part of a control system.

FIG. 24 is a functional block diagram illustrating an example of a configuration of a main part of a control system in the embodiment.

As illustrated in FIG. 24, the driving motor 701, the paper detecting sensors 201*a* to 201*d*, the drawer unit LEDs 112*a* to 112*c*, and the like are connected to the control unit 121 serving as a controller. Furthermore, the straddle detecting sensors 207*a* to 207*c*, the lock detecting sensor 191, the set detecting sensor 172, the right cover LEDs 208*a* and 208*b*, and the like are connected to the control unit 121. Control programs that have been incorporated in the control unit 121 in advance are executed, so that the control unit 121 controls the driving motor 701 to control lock of the drawer unit 76, controls the drawer unit LEDs 112*a* to 112*c* and the right cover LEDs 208*a* and 208*b* to light up, and so on.

Next, described is a lock operation of the drawer unit 76.

Figure 26:
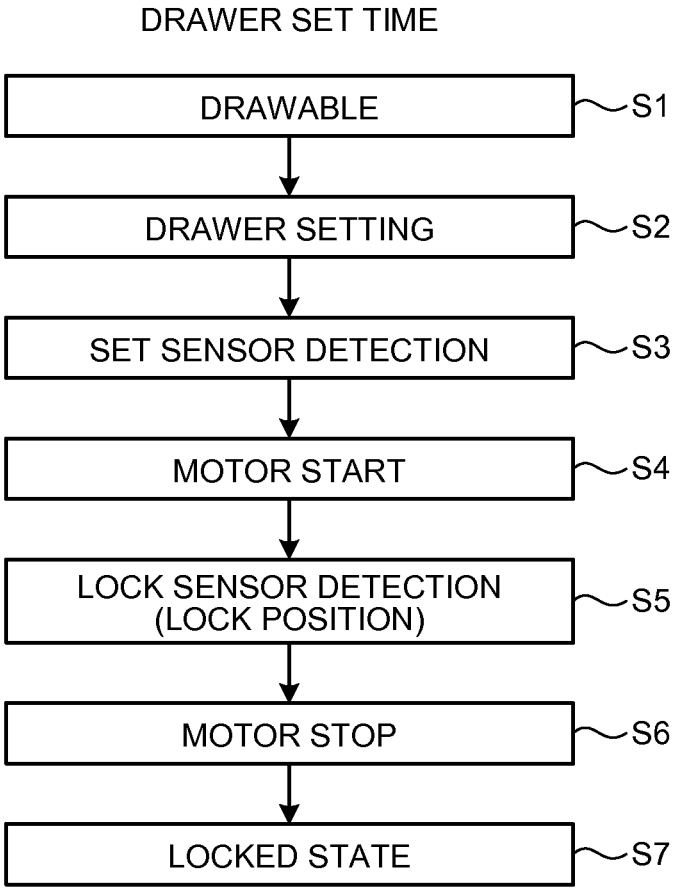
FIG. 26 is a flowchart illustrating an operation when the drawer unit shifts to be in the locked state from the unlocked state.

FIG. 25 is a table for explaining states of the set detecting mechanism, the lock detecting mechanism, and the like when the drawer unit shifts to be in the locked state from the unlocked state. FIG. 26 is a flowchart illustrating an operation when the drawer unit is made to be in the locked state from the unlocked state.

As illustrated in FIG. 25(*a*), when the drawer unit 76 is unlocked and is in a drawable state (step S1 in FIG. 26), the rotating rollers 162 of the lock mechanism 160 are located at positions corresponding to the cutouts 181*a* and 181*b* of the lock receiving member 180. Furthermore, when the drawer unit 76 is in the unlocked state, the lock detection filler 192 of the lock detecting mechanism is located at a position deviated from an opposing portion between the light-receiving part 191*b* and the light-emitting part 191*a* of the lock detecting sensor 191. In this state, the light-receiving part 191*b* of the lock detecting sensor detects light from the light-emitting part 191*a* and is in the "ON: non-shielding state". In addition, in this state, the secondary transfer roller 521 is located at a separated position of being separated from the intermediate transfer belt 54 and the link mechanism 710 is in a state as illustrated in FIG. 12.

When the drawer unit 76 is set to the apparatus main body part 5 from this state (step S2 in FIG. 26), the lock mechanism 160 is inserted into the lock through-hole 184 of the lock receiving member 180. Then, when the rotating rollers 162 are moved to the rear side relative to the end portions of the guide surfaces 183*a* and 183*b* at the drawer unit side, the set detection filler 171 enters between the light-receiving part 172*b* and the light-emitting part 172*a* of the set detecting sensor 172 so as to shield light from the light-emitting part 172*a*. With this, the setting detecting unit detects setting of the drawer unit 76 (step S3 in FIG. 26). Then, driving of the driving motor 701 as illustrated in FIG. 11 is started (step S4 in FIG. 26) so as to rotate the lock shaft 703.

When the lock shaft 703 is rotated, as illustrated in FIG. 25(*b*), the rotating rollers 162 of the lock mechanism 160 make contact with the guide surfaces 183*a* and 183*b* so as to be moved to the lock receiving surfaces 182*a* and 182*b* at the rear side while being guided by the guide surfaces 183*a* and 183*b*. In this manner, the rotating rollers 162 are moved to the rear side while being guided by the guide surfaces 183*a* and 183*b*, so that the lock shaft 703 is drawn to the rear side. Note that as illustrated in FIG. 10, the E ring 722 is fixed to the groove of the lock shaft 703 so as to make contact with the front side surface of the drawer unit rear side plate 151. With this, when the lock shaft 703 tries to be moved to the rear side, the drawer unit rear side plate 151 is pushed to the rear side by the E ring 722 and the drawer unit 76 is drawn to the apparatus main body part 5.

Furthermore, the above-mentioned contact/separation mechanisms are driven through the lock shaft 703 and the link mechanism 710, so that the secondary transfer roller 521 is moved to a contact position from the separated position.

The rotating rollers 162 are attached to the roller shaft 161 in a rotatable manner, so that the rotating rollers 162 are moved on the guide surfaces 183*a* and 183*b* while rotating. This makes it possible to suppress an increase in the friction resistance between the rotating rollers 162 and the guide surfaces 183*a* and 183*b*, thereby drawing the drawer unit to the rear side smoothly.

In the embodiment, employed is a configuration in which the positioning pin 152 is fitted into the positioning hole 502 and positions are determined after drawing by the lock mechanism 160 is started. Alternatively, when employed is a configuration in which the fitting part 152*b* of the positioning pin 152 is fitted into the positioning hole 502 before the drawing is started (the set detecting sensor 172 detects the set detection filler 171), the fitting part 152*b* is fitted into the positioning hole 502 while the drawer unit 76 is pushed manually. As a result, the resistance applied while the drawer unit 76 is pushed manually is increased. This causes the following risk. That is, the user mistakenly considers that he or she has pushed the drawer unit 76 to the above-mentioned drawing start position and stops pushing the drawer unit.

On the other hand, the embodiment employs the configuration in which the positioning pin 152 is fitted into the positioning hole 502 and the positions are determined after the drawing by the lock mechanism 160 is started. This configuration can suppress a drastic increase in the pushing resistance until the drawer unit 76 is pushed to the drawing start position by the lock mechanism 160 (position at which the set detecting sensor 172 detects the set detection filler 171). This makes it possible to push the drawer unit manually to the drawing start position by the lock mechanism 160 reliably.

When employed is a configuration in which connectors are provided on the drawer unit 76 and the apparatus main body part, and the connector on the drawer unit is fitted into the connector on the apparatus main body so as to be energized after the drawer unit is set to the apparatus main body, the following problem is generated. That is, the driving motor 701 can be driven only after the connectors are fitted into each other. When the connectors are fitted into each other, the pushing resistance of the drawer unit is increased. This causes the following risk. That is, the user mistakenly considers that he or she has pushed the drawer unit to the above-mentioned drawing start position and stops pushing the drawer unit.

As for this point, in the embodiment, even in the state where the drawer unit 76 has been drawn out, the drawer unit 76 is in an energized state by the wire bundle 105 so as to drive the driving motor 701. This makes it possible to manually push the drawer unit to the drawing start position reliably in comparison with the configuration in which the connector on the drawer unit is fitted into the connector on the apparatus main body so as to be energized.

The drawer unit 76 is drawn to the rear side by the guide surfaces 183*a* and 183*b* even after the positioning pin 152 is fitted into the positioning hole 502. Then, the seat part 152*c* and the like of the positioning pin 152 provided on the drawer unit rear side plate 151 abuts against the main body rear side plate 501. As illustrated in FIG. 25(*c*), when the rotating rollers 162 of the lock mechanism 160 reach the lock receiving surfaces 182*a* and 182*b*, the lock detection filler 192 enters between the light-receiving part 191*b* and the light-emitting part 191*a* of the lock detecting sensor and the "OFF: shielding state" is made. With this, the lock detecting mechanism detects that the drawer unit 76 has been locked to the apparatus main body part 5 (step S5 in FIG. 26), and driving of the driving motor 701 is stopped (step S6 in FIG. 26). Furthermore, in this case, the secondary transfer roller abuts against the intermediate transfer belt 54 at the predetermined pressure. The link mechanism 710 in this case is in a state as illustrated in FIG. 27.

In the embodiment, the seat part 152*c* and the like of the positioning pin 152 provided on the drawer unit rear side plate 151 abuts against the main body rear side plate 501, and then, the drawer unit 76 is drawn to the rear side by 0 to 1 mm. With this, the drawer unit 76 is locked to the apparatus main body (step S7 in FIG. 26). This makes it possible to lock the drawer unit 76 to the apparatus main body part 5 with no rattling in the front-rear direction. As a result, image disturbance due to vibration at the time of image formation can be prevented, for example. Note that the drawer unit rear side plate 151 that is long in the horizontal direction, the main body rear side plate 501, and the like deflect, and members of the drawer unit 76 that abut against the main body rear side plate 501 and are made of a resin are deformed elastically. With the deflection and the elastic deformation, the drawer unit 76 can be drawn to the rear side by 0 to 1 mm after the seat part 152*c* and the like of the positioning pin 152 abut against the main body rear side plate 501.

As will be described later, when paper jam or the like occurs and generated is the necessity that the drawer unit 76 is drawn out, the driving motor 701 is rotated so as to move the lock mechanism 160 in the counterclockwise direction in the drawings. Then, the rotating rollers 162 are moved to the inclined surfaces 186*a* and 186*b* from the positions on the lock receiving surfaces 182*a* and 182*b*. As illustrated in FIG. 25(*d*), when the rotating roller 162 abutting against the lock receiving surface 182*a* reaches the position of the cutout 181*a* and the rotating roller 162 abutting against the lock receiving surface 182*b* reaches the position of the cutout 181*b*, the lock detection filler 192 is no longer present between the light-receiving part 191*b* and the light-emitting part 191*a* of the lock detecting sensor. With this, the "OFF: shielding state" shifts to the "ON: non-shielding state", and the lock detecting mechanism can detect that the drawer unit 76 has been unlocked.

Figure 27:
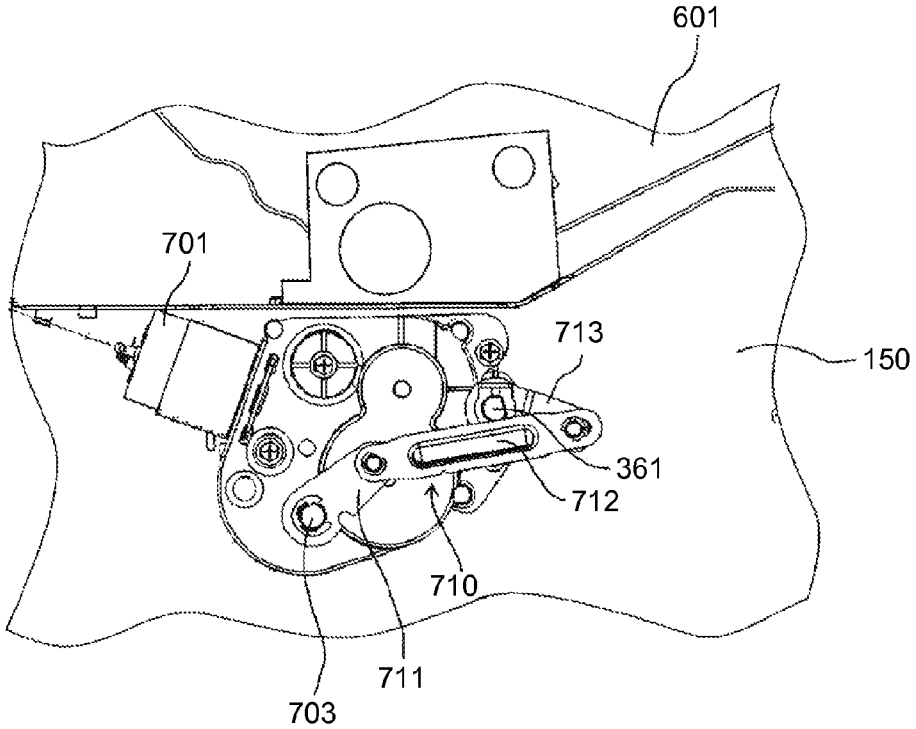
FIG. 27 is a front view illustrating the driving unit when the drawer unit has been locked.

Furthermore, when the lock shaft 703 is moved rotationally in the clockwise direction in FIG. 27 from the above-mentioned state as illustrated in FIG. 27, the input shaft 361 is slightly moved rotationally in the counterclockwise direction in FIG. 27, and then, the rotational movement direction of the input shaft 361 is switched to the clockwise direction in FIG. 27. With this, the secondary transfer roller 521 is switched to be moved in the direction in which it is separated from the intermediate transfer belt 54 from the direction in which it makes closer to the intermediate transfer belt 54. Then, when the drawer unit 76 is unlocked, the link mechanism 710 is made into the above-mentioned state as illustrated in FIG. 12, and the secondary transfer roller 521 reaches the position of being separated from the intermediate transfer belt 54.

In the embodiment, the drawer unit can be locked and unlocked automatically in the above-mentioned manner. This enables the jam processing operation to be simplified in comparison with the case where the lever and the like are provided on the drawer unit and the drawer unit is locked and unlocked manually. With this, efficiency of the jam processing operation can be enhanced.

Furthermore, the secondary transfer roller 521 makes contact with and is separated from the intermediate transfer belt 54 in conjunction with the lock operation of the drawer unit 76. Based on this, when the drawer unit 76 is in the drawable state, the secondary transfer roller 521 can be made into the state of being separated from the intermediate transfer belt 54 surely. This can prevent friction between the secondary transfer roller 521 and the intermediate transfer belt 54 when the drawer unit 76 is drawn out from the apparatus main body, thereby preventing generation of scratches on the surface of the secondary transfer roller 521 and the surface of the intermediate transfer belt 54. Moreover, the secondary transfer roller 521 does not fail to abut against the intermediate transfer belt 54.

The unlock operation is not necessary because the drawer unit 76 is unlocked automatically by driving the driving motor 701. This makes it possible to perform the drawing operation of the drawer unit 76 easily in comparison with the drawer unit 76 is unlocked manually.

As illustrated in FIG. 2, the embodiment employs the configuration in which the front cover 6 is fixed to the drawer unit 76 and the front cover 6 is drawn out together with the drawer unit 76. In this configuration, when employed is a configuration in which the drawer unit 76 is locked and unlocked manually, an operating unit is required to be provided at a place exposed from the apparatus. This problematically results in poor appearance of the apparatus. In order to solve the problem, for example, it is considered that the handle part 6*a* is provided with an operating unit for unlocking the drawer unit. To be specific, when the user grasps the handle part 6*a*, the operating unit is pushed so as to unlock the drawer unit 76. Note that in the embodiment, the drawer unit 76 is drawn to the rear side by 0 to 1 mm after the seat part 152*c* and the like of the positioning pin 152 abut against the main body rear side plate 501 as described above. Large forces are, therefore, necessary when the rotating rollers 162 are moved from the lock receiving surfaces 182*a* and 182*b* so as to unlock the drawer unit 76 and are moved on the guide surfaces 183*a* and 183*b* so as to lock the drawer unit 76. Thus, in order to enable the user to easily lock and unlock the drawer unit 76 that is locked to the apparatus main body part 5 firmly by operating the operating unit as described above, an operation amount of the operating unit is required to be large. That is to say, when employed is the configuration in which the user locks and unlocks the drawer unit 76 that is locked to the apparatus main body part 5 firmly by the operation amount when the user grasps the handle part 6*a*, the user is required to apply a huge amount of force for the operation and is incapable of moving the operating unit easily.

On the other hand, in the embodiment, the drawer unit is locked and unlocked automatically, thereby preventing the appearance of the apparatus from being bad.

In addition, when employed is the configuration in which the lock shaft 703 is rotated easily, there arises a risk that the lock shaft 703 is rotated when the drawer unit 76 is attached. If the lock shaft 703 is rotated when the drawer unit 76 is attached, there arises the following risk. That is, the rotating rollers 162 of the lock mechanism 160 are not inserted into the cutouts 181*a* and 181*b* and abut against the guide surfaces 183*a* and 183*b*, for example, and the drawer unit 76 is incapable of being attached. There is also a risk that when the drawer unit 76 is in the attached state to the apparatus main body part 5, the lock shaft 703 is rotated due to the vibration or the like and the drawer unit is unlocked. In order to avoid the risks, in the embodiment, the worm gear 704 having a large reduction ratio and a high torque is used for transmitting driving to the lock shaft 703 from the driving motor 701. The lock shaft 703 is incapable of being rotated easily by using the worm gear 704. With this, the problems that the drawer unit 76 is incapable of being attached to the apparatus main body and is unlocked due to the vibration or the like can be prevented from occurring.

In the embodiment, as illustrated in FIG. 17, the set detecting sensor 172 is arranged in the vicinity of the lock receiving member 180. When the set detecting sensor 172 is arranged at a position farther from the lock receiving member 180, the following problem occurs. That is, there is a risk that the set detecting sensor 172 detects the filler 171 before the rotating rollers 162 are located at the rear side relative to the guide surfaces 183*a* and 183*b* because it is largely influenced by the deformation of the drawer unit rear side plate 151 and the deformation of the main body rear side plate 501.

On the other hand, the set detecting sensor 172 is arranged in the vicinity of the lock receiving member 180 as in the embodiment, so that influences by the deformation of the drawer unit rear side plate 151 and the deformation of the main body rear side plate 501 can be suppressed. This can prevent the problem that the set detecting sensor 172 detects the filler 171 before the rotating rollers 162 are located at the rear side relative to the guide surfaces 183*a* and 183*b*.

Furthermore, in the embodiment, the respective rotating rollers 162 are guided to the inclined surfaces 186*a* and 186*b* from the lock receiving surfaces 182*a* and 182*b* so as to be moved to the cutouts 181*a* and 181*b* when the drawer unit 76 is unlocked. Thus, the inclined surfaces 186*a* and 186*b* are provided so as to prevent the torque from being changed drastically and prevent load from being applied to the driving motor 701 and the like.

Figure 28:
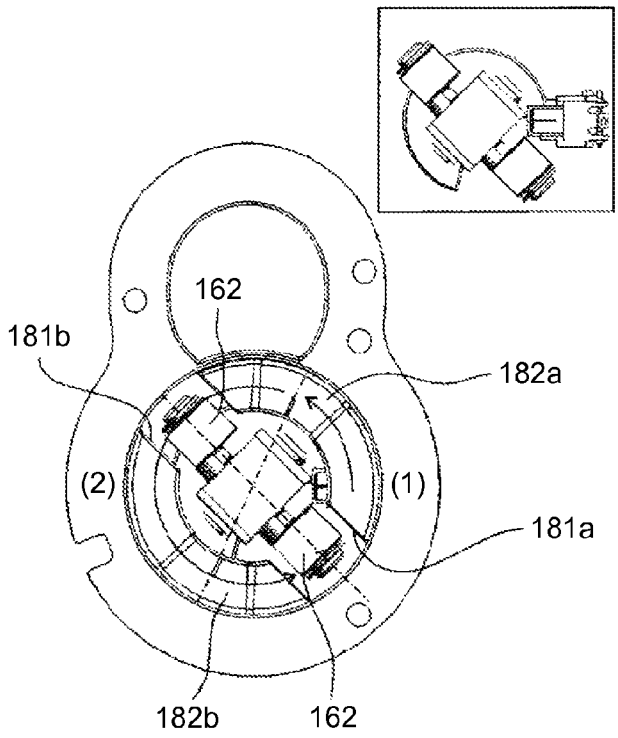
FIG. 28 is a view for explaining movement of rotating rollers when the drawer unit shifts to be in the unlocked state from the locked state.

In the embodiment, as illustrated in FIG. 28, the operation of unlocking→locking→unlocking is performed by a single rotation of the lock shaft 703. The rotating direction of the input shaft 361 is switched in a single rotation of the lock shaft 703 by using the link mechanism 710 so as to cause the secondary transfer roller 521 to make contact with and be separated from the intermediate transfer belt 54, as described above with reference to FIG. 12 and FIG. 27. When the locking of the drawer unit 76 and contact and separation of the secondary transfer roller 521 are performed individually, a configuration as illustrated in FIG. 29 may be employed.

Figure 29:
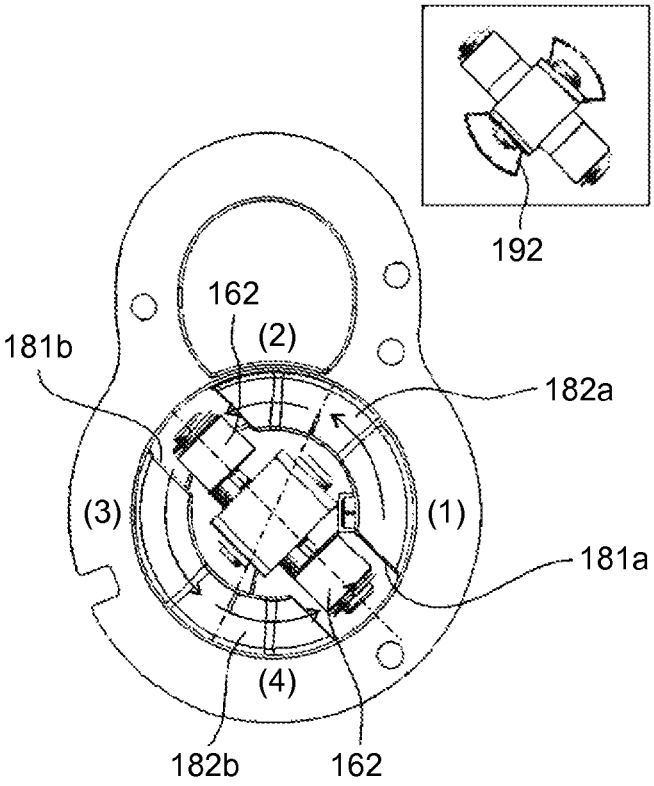
FIG. 29 is a view illustrating a mode in which an operation of unlocking→locking→unlocking is performed by a half (½) rotating operation of a lock shaft.

In the configuration as illustrated in FIG. 29, the operation of unlocking→locking→unlocking is performed by a half (½) rotation of the lock shaft 703. Based on this, the lock detection fillers 192 of the lock detecting mechanism are configured to be formed into fan shapes and be provided at two places at an interval of 180° in the circumferential direction of the lock shaft 703. With this configuration, at a stage where the rotating roller 162 abutting against the lock receiving surface 182*a* reaches the cutout 181*b*, the lock detecting sensor 191 switches to the "ON: non-shielding state" from the "OFF: shielding state" and detects that the drawer unit 76 has been unlocked. This configuration makes it possible to shorten the time taken to shift to the unlocked state from the locked state.

Figure 30:
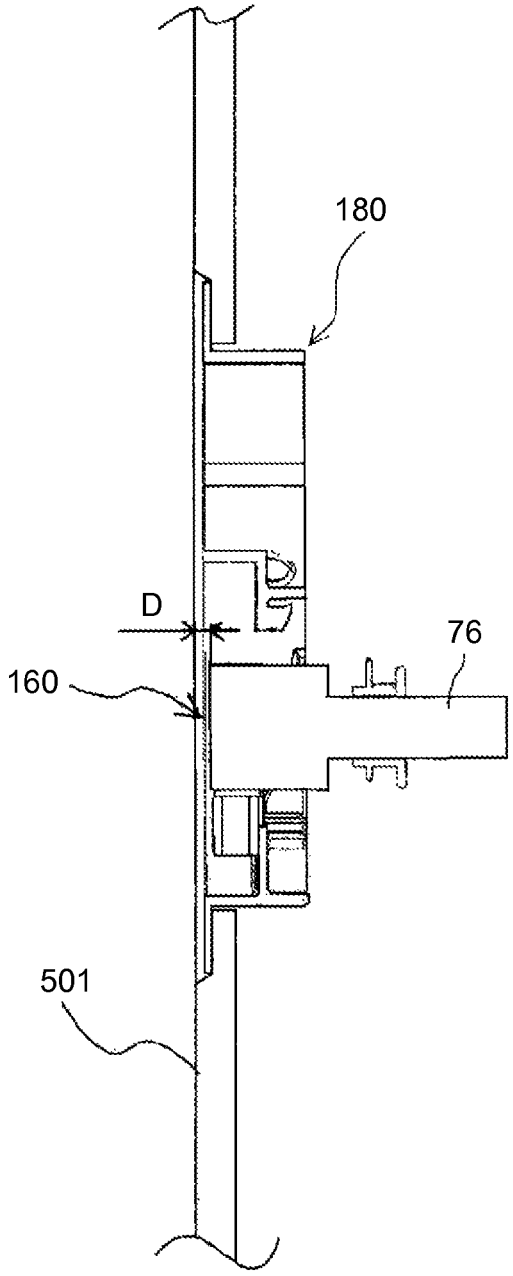
FIG. 30 is a view for explaining a positional relation of the lock receiving member and the lock mechanism in the locked state in the draw-out direction.

Furthermore, in the embodiment, as illustrated in FIG. 30, in the state where the drawer unit 76 is locked, the rear end portion of the lock mechanism 160 is located at the front side relative to the rear surface of the main body rear side plate 501 by a distance D. In this manner, the lock mechanism 160 is made so as not to project from the rear surface of the main body rear side plate 501 when the drawer unit 76 is locked to the apparatus main body. This configuration can provide the secondary transfer driving unit 800 opposed to the lock receiving member 180 as illustrated in FIG. 20 so as to make contact with the rear surface of the main body rear side plate 501. This can reduce the size of the image forming apparatus in the front-rear direction.

Figure 31:
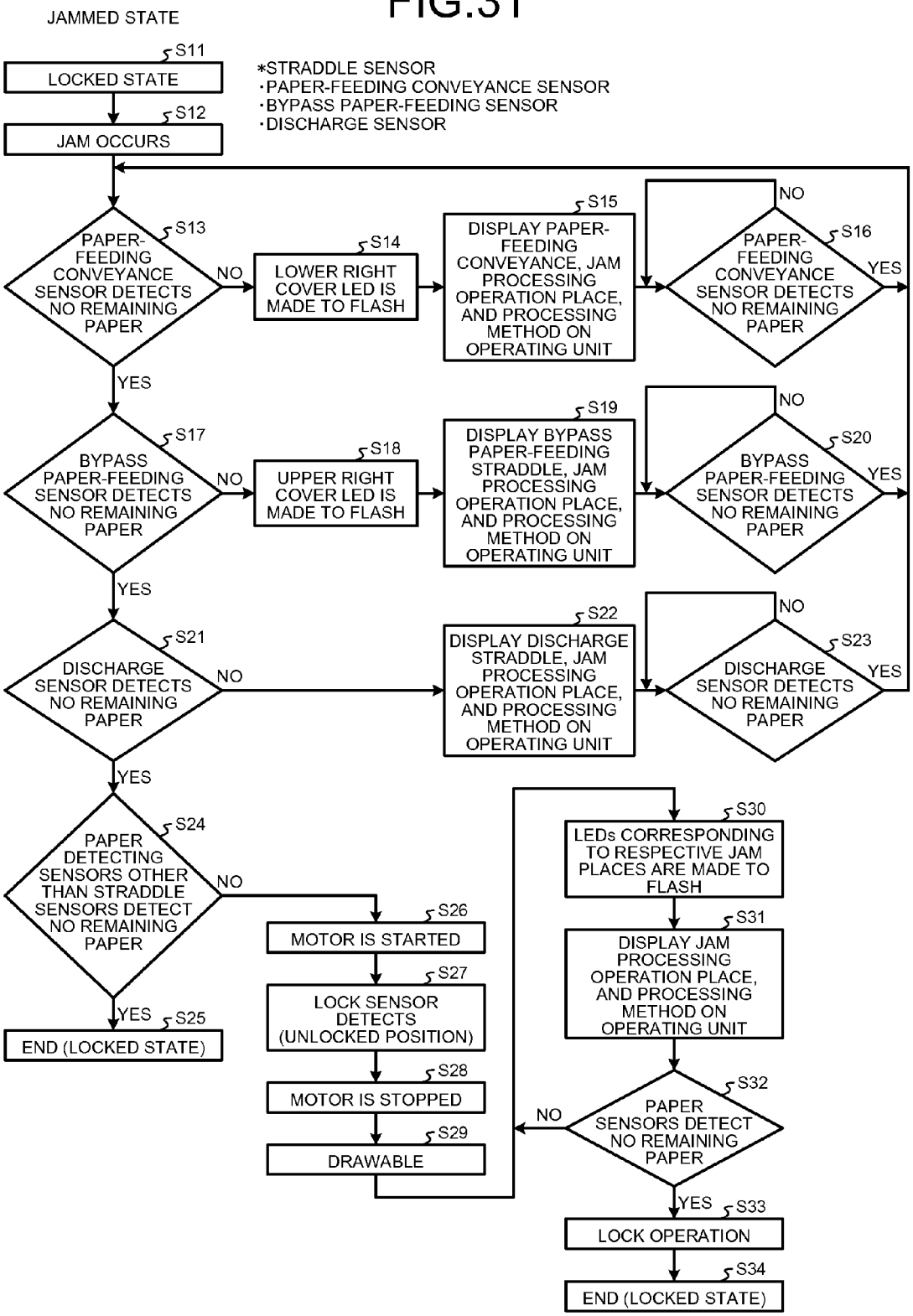
FIG. 31 is a flowchart illustrating an operation when paper jam has occurred.

FIG. 31 is a flowchart illustrating an operation when paper jam has occurred.

When an image formation operation is being performed, the drawer unit 76 is locked to the apparatus main body part 5 (step S11).

When any of the plurality of paper detecting sensors arranged along the paper-feeding conveying paths such as the main conveying path 70 and the reverse conveying path 73 detects the occurrence of the paper jam (step S12), driving of the respective carriage rollers is stopped. Next, the control unit 121 checks whether or not the paper-feeding conveyance sensor 207*a* serving as the straddle detecting sensor detects paper (step S13).

When the paper-feeding conveyance sensor 207*a* detects the paper (No at step S13), the paper is present on the paper-feeding path straddle portion A as illustrated in FIG. 5. In this case, the lower right cover LED 208*a* provided on the right cover member of the paper feeding unit 3 is made to light up. In addition, the operation display unit (not illustrated) is made to display a fact indicating that the paper is present on the paper-feeding path straddle portion A, a jam processing operation place, a jam processing method, and the like so as to notify the user of them (step S15). The user visually checks the operation display unit (not illustrated) and the lower right cover LED 208*a* that lights up, opens the right cover member of the paper feeding unit 3, and removes the paper on the paper-feeding path straddle portion A. Then, when the user finishes the jam processing and the paper-feeding conveyance sensor 207*a* no longer detects the paper (Yes at step S16), the lower right cover LED 208*a* is made to light off and display on the operation display unit is erased.

When the paper-feeding conveyance sensor 207*a* detects no paper (No at step S13), the control unit 121 checks whether the bypass paper-feeding sensor 207*b* detects the paper (step S17). When the bypass paper-feeding sensor 207*b* detects the paper (No at step S17), the paper is present on the bypass path straddle portion B as illustrated in FIG. 5. In this case, the upper right cover LED 208*b* provided on the right cover member of the apparatus main body part 5 is made to light up. In addition, the operation display unit (not illustrated) is made to display a fact indicating that the paper is present on the bypass path straddle portion B, a jam processing operation place, a jam processing method, and the like (step S19). The user operates in accordance with the contents displayed on the operation display unit (not illustrated), visually checks light-up of the lower right cover LED 208*a*, and removes the paper straddling on the bypass path straddle portion B. When the paper straddles on the bypass path straddle portion B, the rear end of the paper is located on the bypass tray 32. The user grasps the paper rear end on the bypass tray and pulls the paper away so as to perform the jam processing. When the user has removed the paper on the bypass path straddle portion B and the bypass paper-feeding sensor 207*b* no longer detects the paper (Yes at step S20), the upper right cover LED 208*b* is made to light off and the display on the operation display unit is erased.

When the paper-feeding conveyance sensor 207*a* and the bypass paper-feeding sensor 207*b* detect no paper (Yes at step S13, Yes at step S17), the control unit 121 checks whether the discharge sensor 207*c* detects the paper (step S21). When the discharge sensor 207*c* detects the paper (No at step S21), the paper is present on the discharge path straddle portion C as illustrated in FIG. 5. In this case, the operation display unit (not illustrated) is made to display a fact indicating that the paper is present on the discharge path straddle portion C, a jam processing operation place, a jam processing method, and the like so as to notify the user of them (step S22). The user operates in accordance with the directions displayed on the operation display unit (not illustrated) and removes the paper on the discharge path straddle portion C. When the paper straddles on the discharge path straddle portion C, the paper front end is located on the discharge tray 61. The user grasps the paper front end on the discharge tray and pulls the paper away so as to perform the jam processing. When the user has removed the paper on the discharge path straddle portion C and the discharge sensor 207*c* no longer detects the paper (Yes at step S23), the display on the operation display unit is erased. Note that an LED may be provided on the left cover member of the apparatus main body part 5 and the LED may be made to light up when the discharge sensor 207*c* detects the paper so as to display the operation place for removing the paper on the discharge path straddle portion C.

When all of the paper-feeding conveyance sensor 207*a*, the bypass paper-feeding sensor 207*b*, and the discharge sensor 207*c* detect no paper (Yes at step S13, Yes at step S17, Yes at step S21), the control unit 121 checks whether any of the plurality of paper detecting sensors arranged along the conveying paths in the drawer unit 76 detects the paper (step S24). When the paper detecting sensors in the drawer unit detect no paper (Yes at step S24), the jam processing is finished (step S25).

On the other hand, when any of the paper detecting sensors in the drawer unit detects the paper (No at step S24), the unlock operation of the drawer unit 76 is executed. That is to say, as described above, the driving motor 701 is driven (step S26) so as to move the rotating rollers 162 abutting against the lock receiving surfaces 182*a* and 182*b* to the positions of the cutouts 181*a* and 181*b*, respectively. Then, when the rotating rollers 162 reach the cutouts 181*a* and 181*b*, and the lock detecting sensor 191 is switched from the "OFF: shielding state" to the "ON: non-shielding state" and detects that the drawer unit 76 has been unlocked (step S27), the driving motor 701 stopped (step S28) and the drawer unit 76 is made into the drawable state (step S29).

Subsequently, the drawer unit LED 112*a*, 112*b*, or 112*c* as illustrated in FIG. 4 is made to light up based on the detection results of the paper detecting sensors arranged on the conveying paths in the drawer unit 76 (step S30). Furthermore, the operation display unit (not illustrated) is made to display a jam processing operation place, a jam processing method, and the like so as to notify the user of them (step S31). For example, when the set detecting sensor 172 detects setting of the drawer unit 76, the operation display unit is made to display a direction to draw out the drawer unit 76. Furthermore, an LED may be provided on the upper portion of the handle part 6*a* of the front cover 6 and be made to light up so as to notify the user of the operation place. When the user draws out the drawer unit 76 and the set detecting sensor 172 no longer detects the setting of the drawer unit 76, the operation display unit is made to display procedures of removing the paper in the drawer unit.

When the user has removed the paper in the conveying path in the drawer unit 76 based on the direction displayed on the operation display unit and the light-up display of the drawer unit LEDs 112*a* to 112*c* and all of the plurality of paper detecting sensors arranged on the conveying paths in the drawer unit 76 no longer detect the paper (step S32), the operation display unit is made to display a direction to close the drawer unit 76. Then, the lock operation flow as illustrated in FIG. 26 is executed (step S33) so as to lock the drawer unit 76, and the jam processing is finished (step S34).

As described above, in the embodiment, when any of the paper-feeding conveyance sensor 207*a*, the bypass paper-feeding sensor 207*b*, and the discharge sensor 207*c* detects the paper, the drawer unit 76 is in the locked state. In other words, the drawer unit 76 is not drawn out in a state whether the paper is present on any of the paper-feeding path straddle portion A, the bypass path straddle portion B, and the discharge path straddle portion C. This can prevent the paper tearing from occurring. Furthermore, in the embodiment, only when the paper is jammed in the conveying path in the drawer unit 76, the drawer unit 76 is unlocked so as to be drawable. This prevents the problem that the drawer unit 76 is drawn out carelessly and parts in the drawer unit 76 are scratched.

In the embodiment, the operation display unit and the LEDs display the operation place of the paper jam processing so as to cause the user to perform the jam processing operation appropriately. This can prevent the user from trying to draw out the drawer unit 76 in the locked state.

Furthermore, described has been the embodiment in which the invention is applied to the image forming apparatus having the following configuration. That is, the image forming apparatus has the configuration in which the front cover 6 is attached to the drawer unit 76 and the drawer unit 76 is drawn out integrally with the front cover 6. Alternatively, the invention can be also applied to the image forming apparatus having the configuration as illustrated in FIG. 8. Note that the configuration as illustrated in FIG. 8 is the configuration in which the front covers 6 and the drawer unit 76 are formed as separate members, and the drawer unit 76 is drawn out after the front covers 6 are opened. Also in the configuration as illustrated in FIG. 8, when the paper is present on any of the paper-feeding path straddle portion A, the bypass path straddle portion B, and the discharge path straddle portion C, the drawer unit is locked automatically so as not to be drawn out. This can prevent the paper tearing from occurring.

Alternatively, a configuration in which only a part of the front cover 6 that covers the drawer unit 76 is attached to the drawer unit 76 and only the part is drawn out integrally with the drawer unit 76 may be employed.

Figure 32:
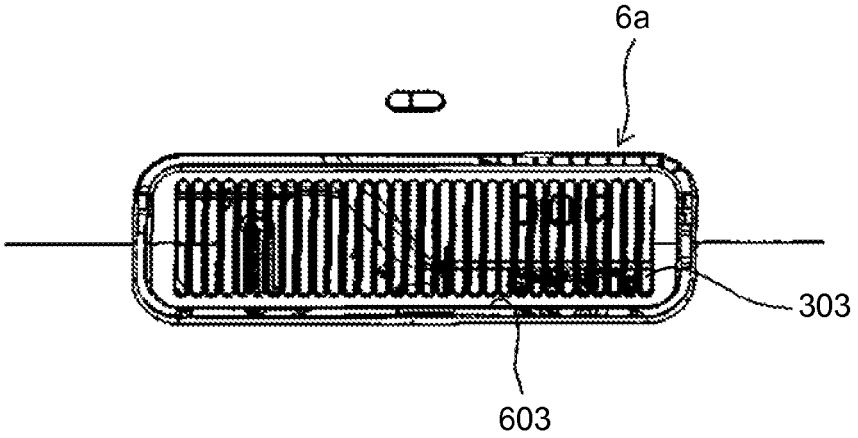
FIG. 32 is an enlarged view illustrating the vicinity of a handle part of the front cover.
Figure 33:
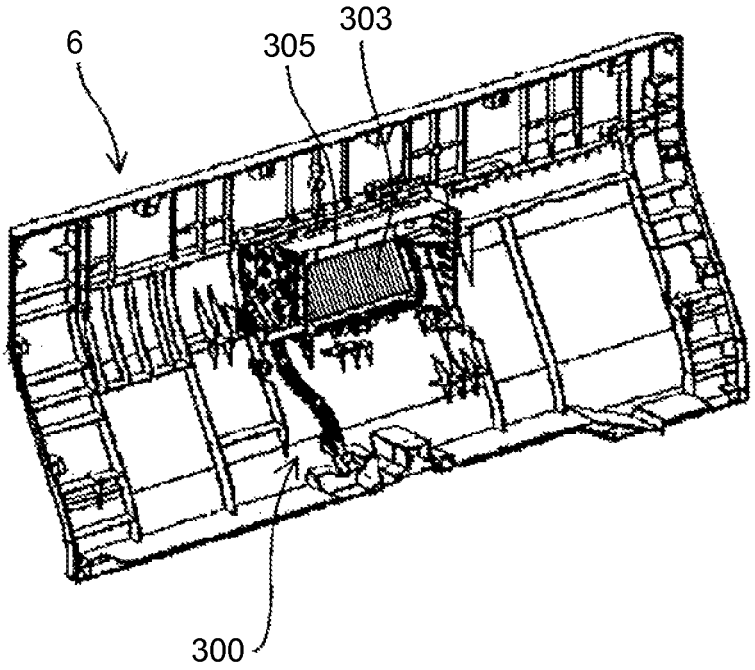
FIG. 33 is a perspective view illustrating the front cover detached from the drawer unit when seen from the back surface.

FIG. 32 is an enlarged view illustrating the vicinity of the handle part 6*a* of the front cover 6. FIG. 33 is a perspective view illustrating the front cover 6 detached from the drawer unit 76 when seen from the back surface.

As illustrated in FIG. 32 and FIG. 33, the outer cover part 602 of the front cover 6 is provided with the handle part 6*a* including an opening 603 in which the user puts his or her hand. A flapper 303 is attached to the opening 603 of the handle part 6*a* in a rotationally movable manner.

Figure 34:
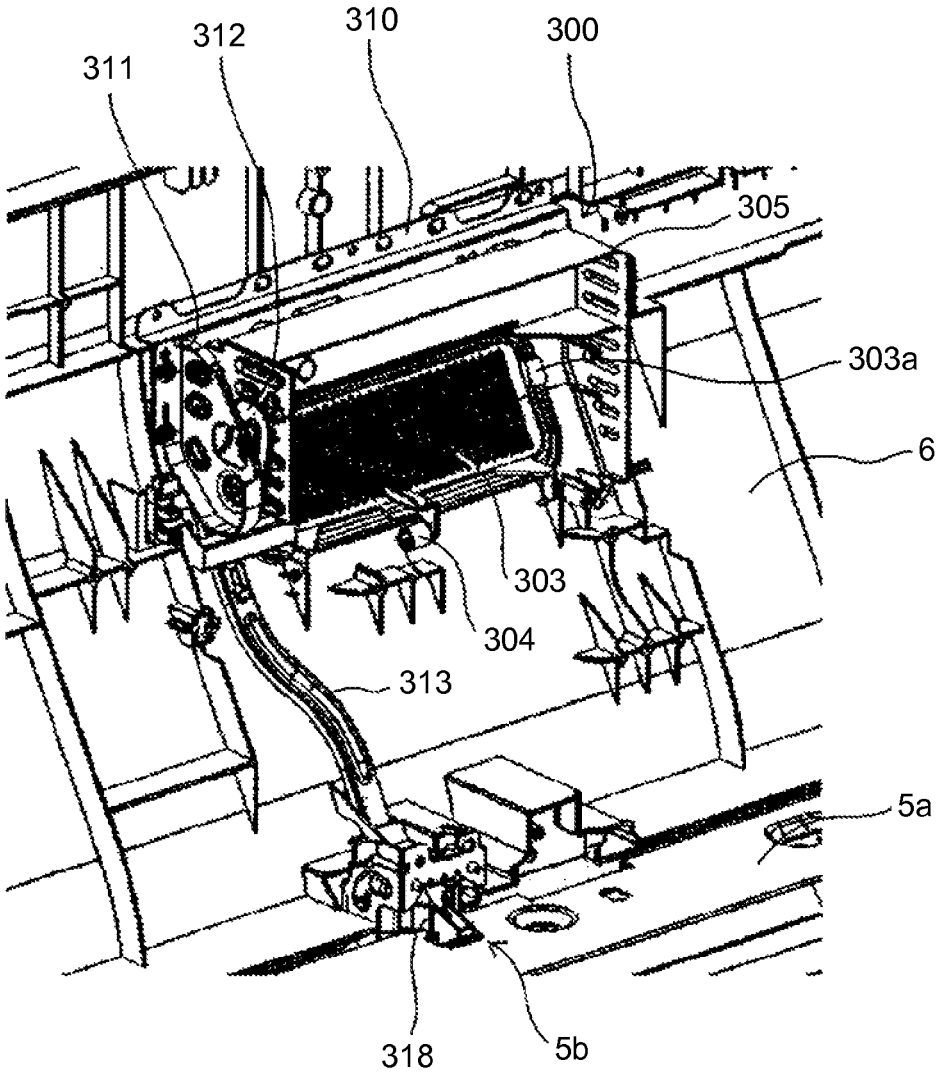
FIG. 34 is an enlarged perspective view illustrating the vicinity of the handle part in FIG. 33.
Figure 35:
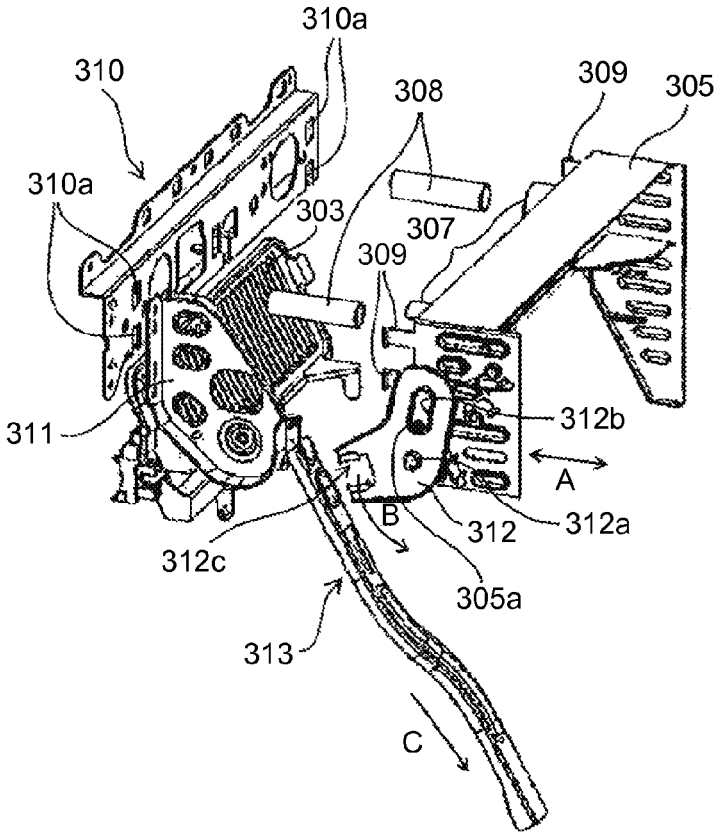
FIG. 35 is an exploded configuration view illustrating the vicinity of the handle part.
Figure 36:
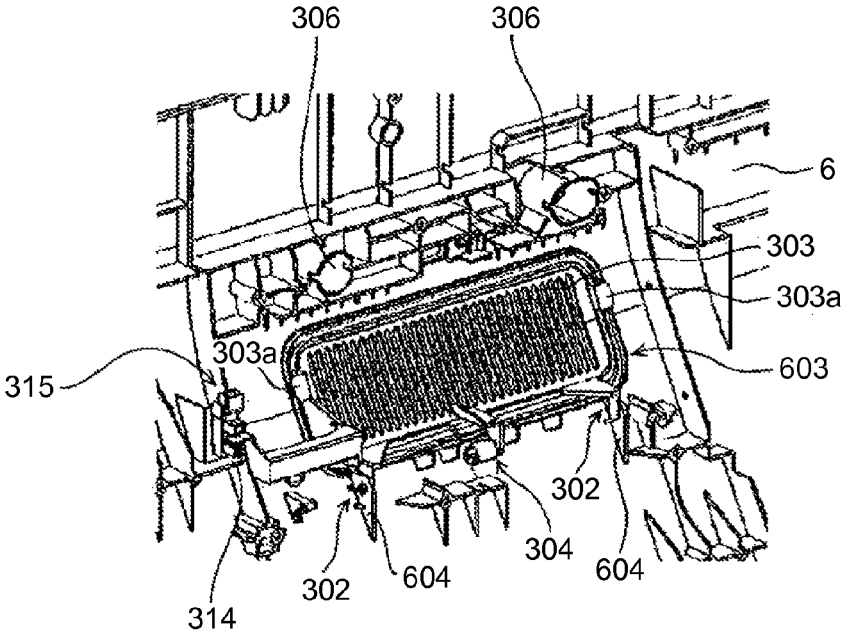
FIG. 36 is a perspective view illustrating the vicinity of the handle part of the front cover from which a mechanical lock mechanism has been detached when seen from the back surface.

FIG. 34 is an enlarged perspective view illustrating the vicinity of the handle part 6*a* in FIG. 33. FIG. 35 is an exploded perspective view illustrating the vicinity of the handle part 6*a*. FIG. 36 is a perspective view illustrating the vicinity of the handle part of the front cover 6 from which a mechanical lock mechanism 300 has been detached when seen from the back surface.

As illustrated in FIG. 36, attachment parts 302 are provided on the lower end of the flapper 303 in the vicinity of the right and left end portions thereof in FIG. 36. These attachment parts 302 are attached to flapper attachment parts 604 of the front cover 6 in a rotatable manner. A torsion spring 304 biases the flapper 303 to the front cover 6 side. Locking parts 303*a* are provided on both end portions of the flapper 303.

The locking parts 303*a* abut against the edge portion of the opening 603 of the front cover 6 so as to stop the flapper 303 on the same plane as the front cover 6 when no external force is applied.

Furthermore, a flapper open/close detecting sensor 315 is provided on the front cover 6 at the left side relative to the opening 603 in FIG. 36. The flapper open/close detecting sensor 315 is a transparent optical sensor. When the flapper 303 is closed, a shielding plate 314 that is integrally provided to the flapper 303 is located between a light-emitting element and a light-receiving element of the above-mentioned sensor. That is to say, when the flapper 303 is closed, the shielding plate 314 shields light from the light-emitting element.

When the user puts his or her hand in the opening 603 of the handle part 6*a* of the front cover 6, the flapper 303 rotates against the biasing force by the torsion spring 304 and the flapper 303 falls down in the apparatus. Then, the shielding plate 314 that is integrally provided to the flapper 303 is separated from the position between the light-emitting element and the light-receiving element of the flapper open/close detecting sensor 315. With this, the light-receiving element of the flapper open/close detecting sensor 315 detects light from the light-emitting element so as to detect that the flapper 303 has been opened. Based on this, it is detected that the user performs an operation for drawing out the drawer unit. That is to say, in the embodiment, the above-mentioned flapper open/close detecting sensor 315 and the shielding plate 314 of the flapper 303 function as an operation detecting unit that detects the operation of the user when the user draws out the drawer unit 76. As will be described later, the control unit 121 controls to lock and unlock the lock mechanism 160 based on the detection result of the flapper open/close detecting sensor 315.

Outer appearance quality of the apparatus can be improved by hiding the opening 603 of the handle part 6*a* by the flapper 303 as described above. In the embodiment, as illustrated in FIG. 32, the flapper 303 is provided with slits and the opening 603 of the handle part 6*a* is used as an air inlet for sucking the outside air into the apparatus or an air outlet for discharging the air in the apparatus. To be specific, the air introduced into the apparatus by a suction fan provided on another part is discharged through the opening 603 of the handle part 6*a* with airflow design in the drawer unit 76. Furthermore, the air discharge by an exhaust fan provided on another part causes the inner portion of the apparatus to have a negative pressure, so that the air can be sucked through the opening 603 of the handle part 6*a*.

In general, it is difficult to provide an air outlet/inlet for cooling the apparatus, such as a louver, on the front surface of the image forming apparatus due to the constraint in design. Accordingly, the cooling processing is executed on the right and left surfaces and the back surface of the image forming apparatus conventionally. These surfaces are, however, covered by a peripheral apparatus, a wall, or a shelf depending on the installation places in many cases. Due to this, the outside air is incapable of being introduced into the apparatus sufficiently or the air is incapable of being discharged sufficiently. The problem can be solved by adding parts such as a fan and a duct but the cost of the apparatus is increased. In order to avoid this, in the embodiment, the air can be sucked and discharged through the opening 603 of the handle part 6*a* on the front surface of the image forming apparatus that is not covered by the peripheral apparatus or the wall. This makes it possible to cool the apparatus preferably without adding the parts such as the fan and the duct. Moreover, the deterioration in the appearance of the front surface of the image forming apparatus can be prevented to the minimum necessary level by using the handle part 6*a* as the air inlet and the air outlet.

Furthermore, in the embodiment, the mechanical lock mechanism 300 is provided that locks and unlocks the drawer unit 76 with a mechanical operation made by the user in addition to the lock mechanism 160 that drives the driving motor 701 so as to lock the drawer unit 76 electrically.

The lock mechanism 160 in the embodiment unlocks the drawer unit 76 in a state where the power supply of the apparatus is in the OFF state, for example, when the apparatus is powered OFF for the following reason. If the lock mechanism 160 locks the drawer unit 76 when the power supply of the apparatus is in the OFF state, the lock mechanism 160 is incapable of unlocking the drawer unit 76 only after the apparatus is powered ON. Note that in the embodiment, the driving force of the driving motor 701 is transmitted through the worm gear 704 having the high torque as described above. Accordingly, it is difficult to cancel the lock by the lock mechanism 160 manually. For this reason, when the user draws out the drawer unit to perform maintenance in the state where the power supply of the apparatus is in the OFF state, the apparatus needs to be powered ON first, and then, an operation of cancelling the lock by the automatic lock mechanism has to be performed. This requires extra work, resulting in bad operability.

In view of this circumstance, in the embodiment, the drawer unit 76 is unlocked when the power supply of the apparatus is in the OFF state. To be specific, for example, when a power supply switch of the apparatus is switched to be in the OFF state from the ON state, the driving motor 701 is driven to cancel the lock by the lock mechanism 160, and then, the apparatus is powered OFF. Then, when the power supply switch of the apparatus is switched to be in the ON state from the OFF state and the apparatus is powered ON, the driving motor 701 is driven so as to lock the drawer unit 76 by the lock mechanism.

In this manner, when the power supply of the apparatus is in the OFF state, the drawer unit 76 is unlocked. For this reason, when the apparatus is powered OFF and the image forming apparatus is transported and so on, there is a risk that the drawer unit is slid out from the apparatus main body due to the vibration and the like. In order to avoid this, in the embodiment, the mechanical lock mechanism 300 is provided that locks and unlocks the drawer unit 76 with a mechanical operation made by the user.

As illustrated in FIG. 34, the mechanical lock mechanism 300 as a second lock unit includes a lever 305, an input link 312, an output link 313, and a stopper 318.

As illustrated in FIG. 35, the lever 305 has a substantially inverted recess shape including an upper surface portion and side surface portions. The side surface portions droop perpendicularly from both ends of the upper surface portion in the lengthwise direction. The lever 305 also includes a surface portion that droop perpendicularly from an end portion of the upper surface portion at the front cover 6 side. Cylindrical lock-side spring holding parts 307 holding compression springs 308 are provided on the surface portion in the vicinity of both end portions in the lengthwise direction. Furthermore, elastic claw parts 309 are provided on both side surface portions of the lever 305 at the end portions at the front cover side. The elastic claw parts 309 are provided on each side surface portion at two places in the up-down direction in FIG. 35. The elastic claw parts 309 extend to the front cover side and have shapes that front ends thereof are bent outward. These elastic claw parts 309 are inserted into hooking holes

310*a* provided on a handle bracket 310 fixed to the front cover 6 and the front ends of the elastic claw parts 309 are hooked on the handle bracket 310.

As illustrated in FIG. 36, the front cover 6 is also provided with a pair of cylindrical cover-side spring holding parts 306 holding the compression springs 308. The inner diameters of the cover-side spring holding parts 306 are larger than the outer diameters of the lock-side spring holding parts 307. When the lever 305 is attached to the front cover 6 by hooking the elastic claw parts 309 on the handle bracket 310 of the front cover 6, the lock-side spring holding parts 307 are fitted into the cover-side spring holding parts 306. When the lever 305 is attached to the front cover 6, the compression springs 308 are set in the lock-side spring holding parts 307 and are fitted into the cover-side spring holding parts 306. With this, the lever 305 is attached in a state of being biased by the compression springs 308 in the direction of being separated from the front cover 6. In addition, the front ends of the elastic claw parts 309 provided on the lever 305 are hooked to the handle bracket 310 from the front cover 6 side. With this configuration, the lever 305 is attached to the front cover 6 so as to reciprocate with respect to the front cover 6 as indicated by an arrowed line A shown in FIG. 35.

As illustrated in FIG. 35, the input link 312 is fixed to the side surface portion of the lever 305 at the near side in FIG. 35. The input link 312 has a substantially arch shape curved to the front cover 6 side and includes a rotating shaft 312*a*, a long hole 312*b*, and an attachment part 312*c* to which the bar-shaped output link 313 is attached. The input link 312 is attached to the side surface portion of the lever 305 by inserting a shoulder screw 305*a* into the long hole 312*b* of the input link 312. The shoulder screw 305*a* is fastened to the lever 305 so as to be movable relatively to the long hole 312*b*. The rotating shaft 312*a* of the input link 312 is attached to a fulcrum bracket 311 fixed to the end portion of the handle bracket 310 at the near side in FIG. 35 in a rotatable manner. That is to say, the input link 312 is attached so as to couple the lever 305 and the fulcrum bracket 311. An upper end portion of the bar-shaped output link 313 is attached to the attachment part 312*c* of the input link 312.

Figure 37:
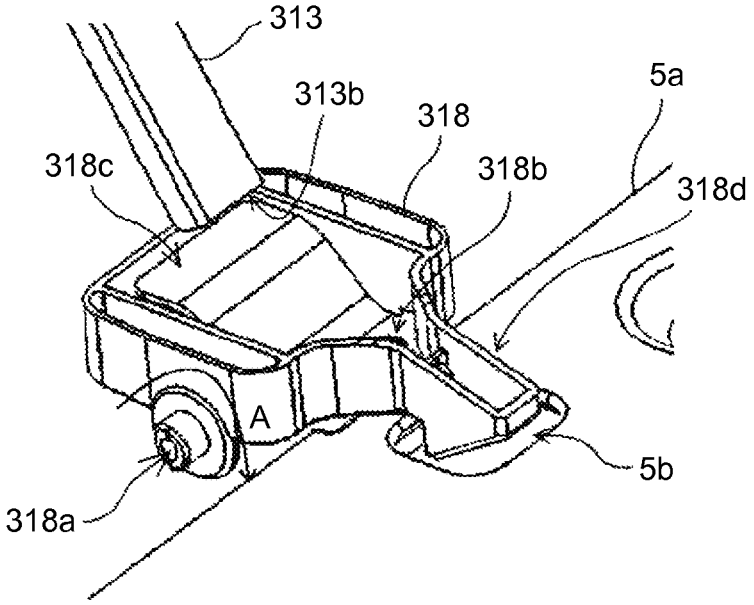
FIG. 37 is a perspective view illustrating the vicinity of a stopper.
Figure 38:
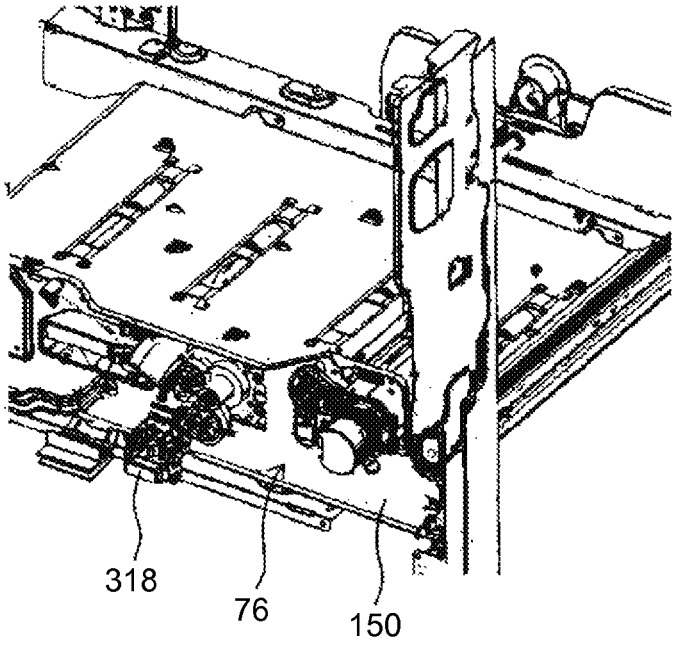
FIG. 38 is a view illustrating a configuration in which the stopper is held on a drawer unit front side plate.
Figure 39:
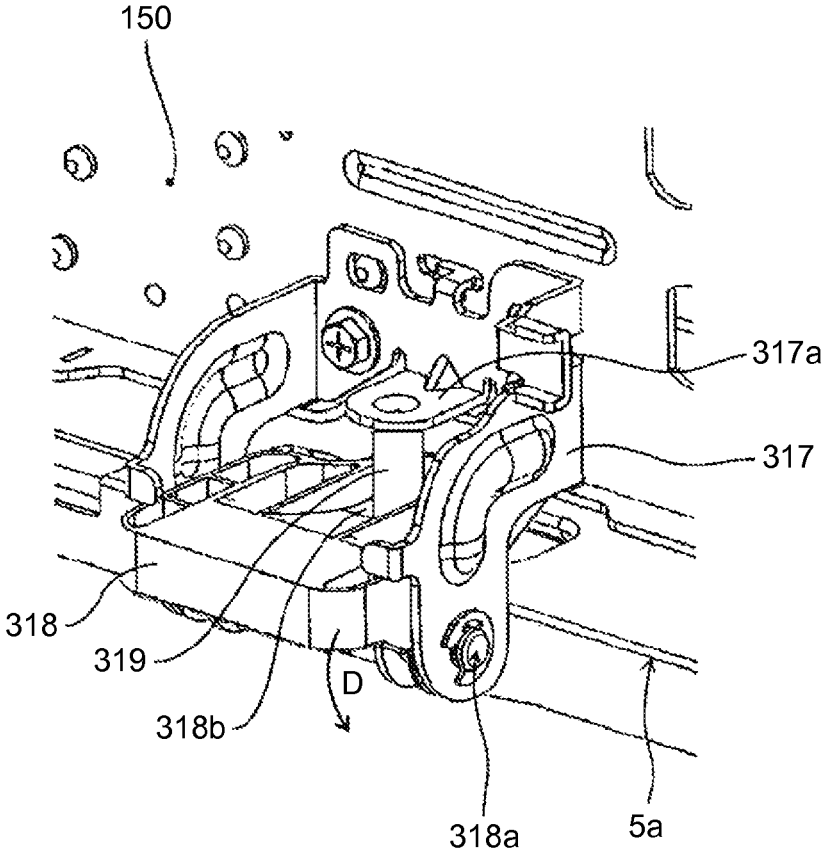
FIG. 39 is an enlarged perspective view illustrating the vicinity of a portion of the drawer unit front side plate that holds the stopper.

FIG. 37 is a perspective view illustrating the vicinity of the stopper 318 and FIG. 38 is a view illustrating a configuration in which the stopper 318 is held on the drawer unit front side plate 150. FIG. 39 is an enlarged perspective view illustrating the vicinity of a portion of the drawer unit front side plate 150 that holds the stopper 318.

As illustrated in FIG. 37, a lower end 313*b* of the bar-shaped output link 313 is opposed to the stopper 318.

The stopper 318 is provided with a claw part 318*d*, a rotating shaft part 318*a*, an abutting surface 318*c*, a spring receiving part 318*b*, and the like. The claw part 318*d* is hooked on a lock hole 5*b* provided on a horizontal frame 5*a* of the apparatus main body part 5.

As illustrated in FIG. 39, the stopper 318 is held on a stopper bracket 317 fixed to the drawer unit front side plate 150 in a rotatable manner. To be specific, the rotating shaft part 318*a* of the stopper 318 is attached to a hole provided on the stopper bracket 317, so that the stopper 318 is held on the stopper bracket 317 in a rotatable manner.

Furthermore, a spring receiving part 317*a* is also provided on the stopper bracket 317. The spring receiving part 318*b* of the stopper 318 and the spring receiving part 317*a* of the stopper bracket 317 holds a compression spring 319. The compression spring 319 biases the stopper 318 at the claw part 318*d* side to the horizontal frame 5*a* side.

Next, described is an operation of the mechanical lock mechanism 300.

Figure 40:
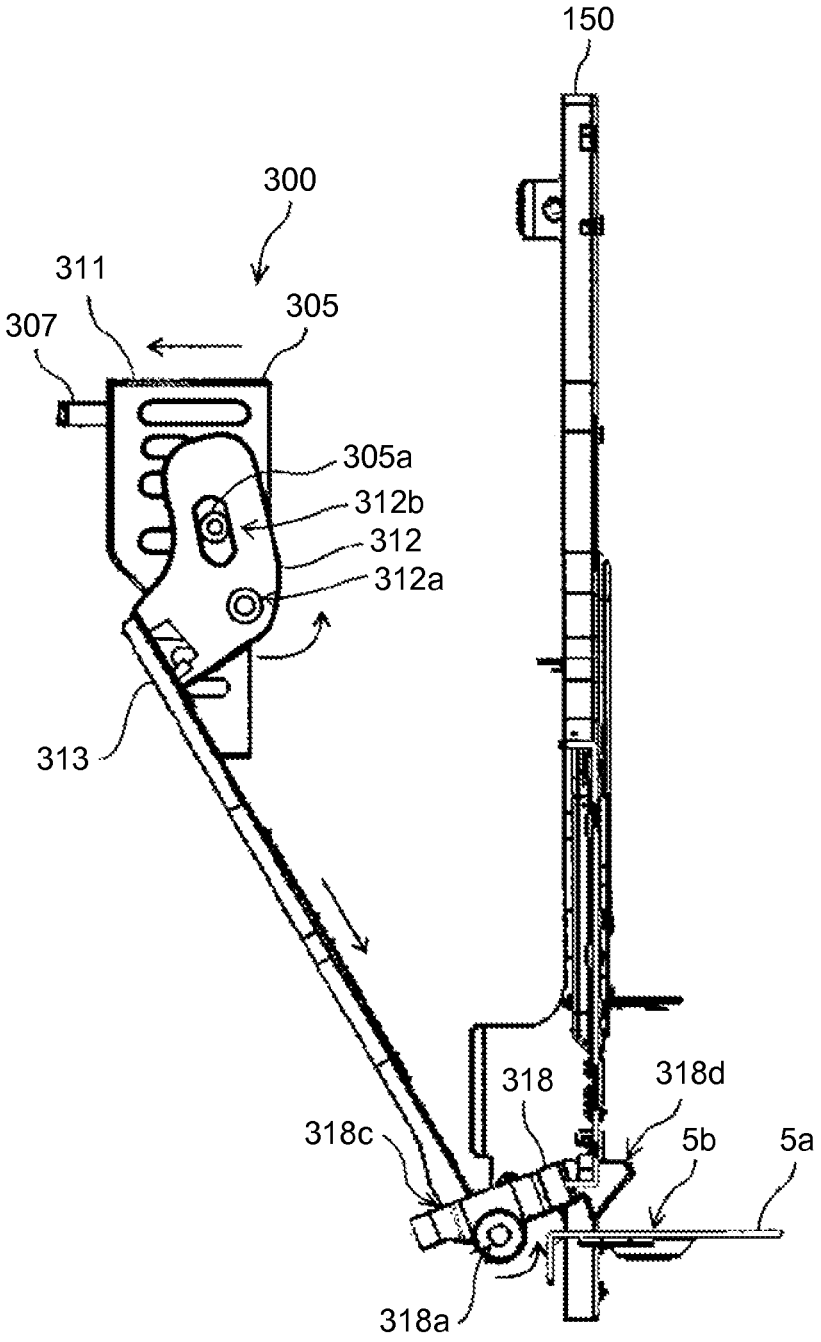
FIG. 40 is a descriptive view for explaining an unlock operation made by the mechanical lock mechanism.

FIG. 40 is a descriptive view for explaining an unlock operation made by the mechanical lock mechanism 300.

A user puts his or her hand in the handle part 6*a* provided on the front cover 6 and pushes and opens the flapper 303. Then, the user grasps the lever 305 so as to pull it to the front cover 6 side. With this, the lever 305 is moved to the front cover 6 side against the biasing force of the compression springs 308 held by the lock-side spring holding parts 307 and the cover-side spring holding parts 306.

The shoulder screw 305*a* inserted into the long hole 312*b* of the input link 312 is moved to the front cover 6 side in conjunction with the movement of the lever 305 to the front cover 6 side. With this, the input link 312 is moved rotationally about the rotating shaft 312*a* in the counterclockwise direction in FIG. 40. The input link 312 is moved rotationally in this manner, so that the bar-shaped output link 313 of which upper portion is attached to the input link 312 is moved downward by being pressed by the input link 312. Then, the lower end of the output link 313 presses the abutting surface 318*c* of the stopper 318.

The lower end of the output link 313 presses the abutting surface 318*c* of the stopper 318, so that the stopper 318 is moved rotationally about the rotating shaft part 318*a* in the counterclockwise direction in FIG. 40 against the biasing force of the compression spring 319. The claw part 318*d* fitted into the lock hole 5*b* of the horizontal frame 5*a* is disengaged from the lock hole 5*b* with the rotational movement. With this, the drawer unit 76 is unlocked from the apparatus main body part 5 by the mechanical lock mechanism 300, so that the drawer unit 76 can be drawn out from the apparatus main body part 5.

Figure 41:
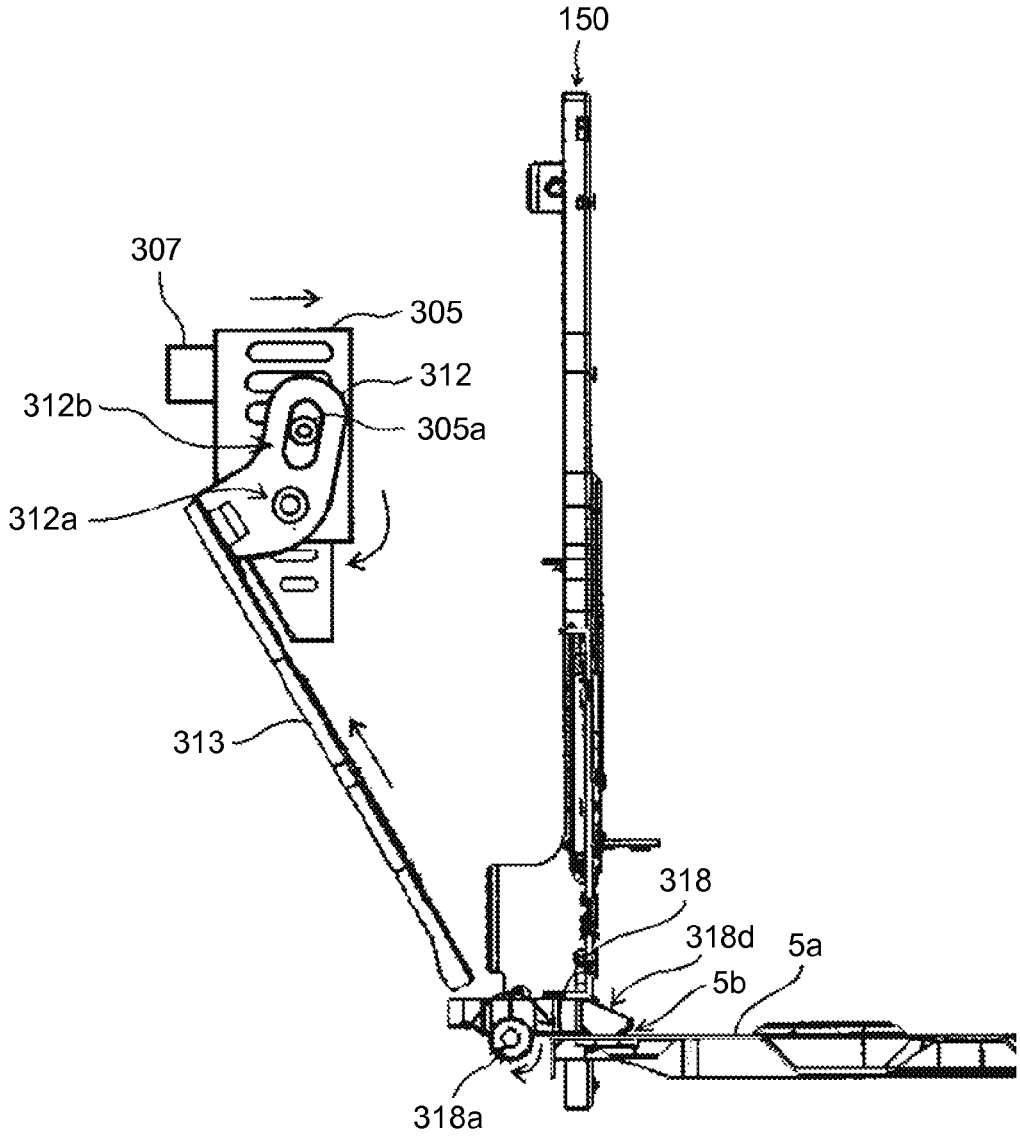
FIG. 41 is a descriptive view for explaining a lock operation made by the mechanical lock mechanism.

FIG. 41 is a descriptive view for explaining a lock operation made by the mechanical lock mechanism 300.

When the user releases the lever 305, the lever 305 is moved in the direction of being separated from the front cover 6 side by the biasing force of the compression springs 308 held by the lock-side spring holding parts 307 and the cover-side spring holding parts 306. Then, the front ends of the elastic claw parts 309 as illustrated in FIG. 35 are hooked on the hooking holes 310*a* of the handle bracket 310, so that the lever 305 is returned to an initial position.

Furthermore, the input link 312 is moved rotationally in the clockwise direction in FIG. 41 so as to lift the output link 313 with the above-mentioned movement of the lever 305 to the initial position. With this, the lower end of the output link 313 is separated from the stopper 318. Then, the stopper 318 is moved rotationally in the clockwise direction in FIG. 41 by the biasing force of the compression spring 319 (see FIG. 39), so that the claw part 318*d* is fitted into the lock hole 5*b*. With this, the mechanical lock mechanism 300 locks the drawer unit 76 so as not to be drawn out.

In the embodiment, the claw part 318*d* of the stopper has a tapered surface that becomes higher toward the rear side from the front side. Furthermore, the output link 313 is separated from the stopper 318 in a state where the user does not grasp the lever 305. This configuration enables the drawer unit to be set to the apparatus main body even when the user pushes the drawer unit 76 in the state where the user does not grasp the lever 305 in the embodiment. As is described in detail, as the user pushes the drawer unit in the state where the user does not grasp the lever 305, the claw part 318*d* of the stopper 318 abuts against the horizontal frame 5*a*. In the embodiment, the claw part 318*d* of the stopper 318 has the tapered surface, so that the tapered surface abuts against the horizontal frame 5*a*. Accordingly, as the user further pushes the drawer unit from this state, the stopper 318 is moved rotationally in the counterclockwise direction in FIG. 41 by the tapered surface and the claw part 318*d* is capable of climbing over the horizontal frame 5*a*. Furthermore, the output link 313 is separated from the stopper 318, so that the claw part 318*d* can be placed on the horizontal frame 5*a* only by the rotational movement of the stopper 318. The drag force when the claw part 318*d* is placed on the horizontal frame 5*a* is only the biasing force of the compression spring 319 (see FIG. 39) biasing the claw part of the stopper downward. This makes it possible to place the claw part 318*d* on the horizontal frame 5*a* easily. Then, as the user further pushes the drawer unit 76, the claw part 318*d* is fitted into the lock hole 5*b*. In this manner, the drawer unit 76 can be set to the apparatus main body even when the user does not grasp the lever 305. When the drawer unit 76 is set to the apparatus main body, the mechanical lock mechanism 300 is capable of locking the drawer unit 76 automatically.

As described above, in the embodiment, the mechanical lock mechanism 300 is provided, so that even when the power supply is in the OFF state and the lock by the lock mechanism 160 is cancelled, the mechanical lock mechanism 300 is capable of locking the drawer unit. Furthermore, the user puts his or her hand in the handle part and performs the operation of drawing out the drawer unit 76 so as to move the lever 305 and cancel the lock by the mechanical lock mechanism 300. With this, when the power supply of the apparatus is in the OFF state, the drawer unit 76 is unlocked without requiring to perform a specific operation, thereby drawing out the drawer unit 76 with no effort. This makes it possible to improve maintenance operability of the drawer unit 76 when the power supply is in the OFF state.

The mechanical lock mechanism 300 in the embodiment unlocks the drawer unit 76 from the apparatus main body part 5 only when the user puts his or her hand in the handle part 6*a* and grasps the lever 305. Furthermore, the lever 305 is arranged at the drawer unit rear side relative to the flapper 303. With this, a force that is large enough to displace the lever 305 to the front cover 6 side is not applied to the lever 305 even when it receives vibration and impact, so that the drawer unit 76 is not unlocked from the apparatus main body part 5. That is to say, the mechanical lock mechanism 300 locks the drawer unit 76 to the apparatus main body part 5 so as to prevent the drawer unit 76 from sliding out from the apparatus main body part 5 due to the vibration and the like even when the power supply is in the OFF state and the lock mechanism 160 is in the unlocking state.

When the drawer unit is being locked by the lock mechanism 160 (hereinafter, referred to as electric lock mechanism) that locks the drawer unit electrically, the drawer unit 76 is incapable of being drawn out even when lock by the mechanical lock mechanism 300 is cancelled. For coping with this, in the embodiment, the flapper open/close detecting sensor 315 detects opening/closing of the flapper so as to detect whether the user performs an operation of drawing out the drawer unit. Based on this, the locking by the lock mechanism 160 is cancelled.

Figure 42:
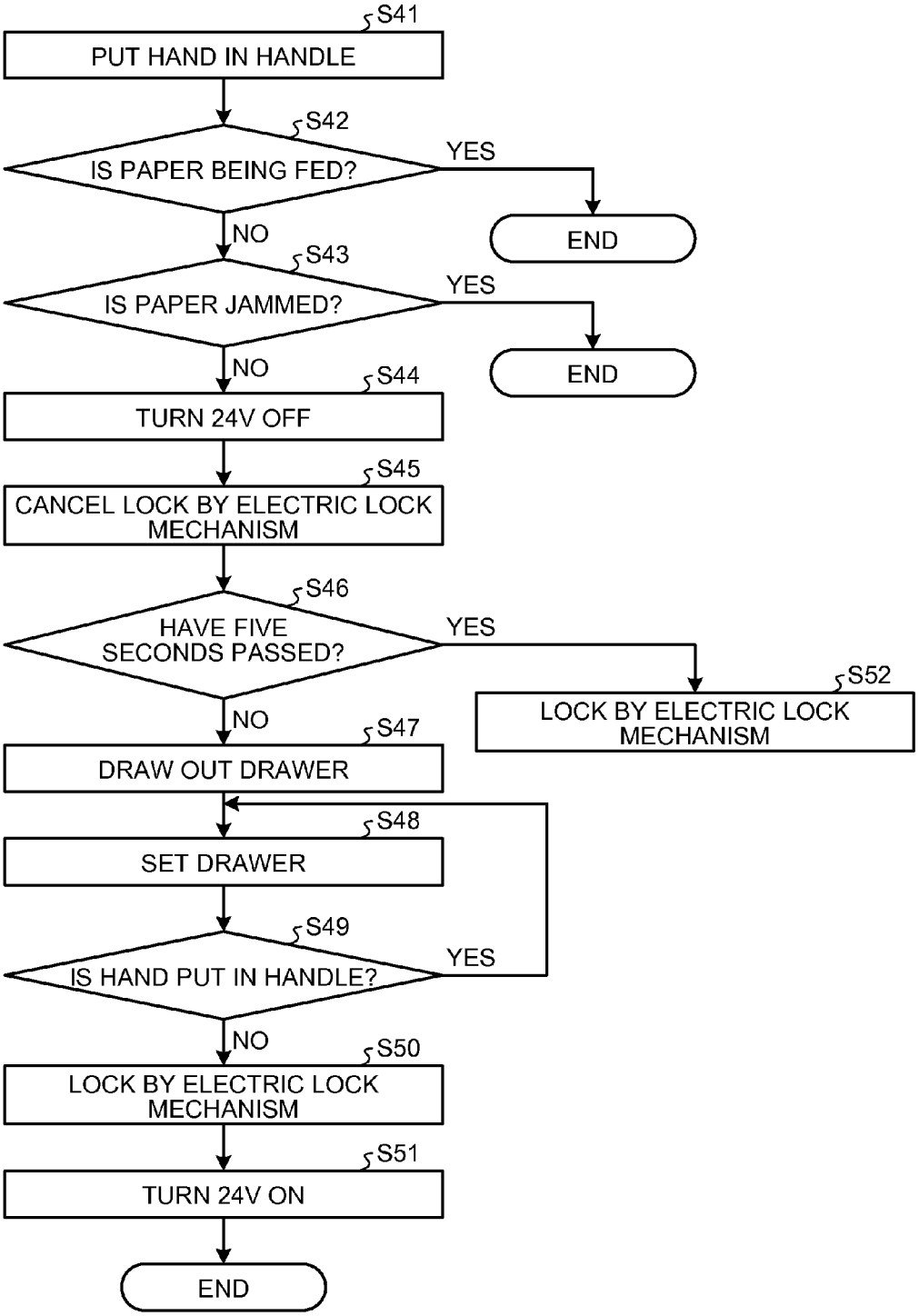
FIG. 42 is a control flowchart based on a detection result made by a flapper open/close detecting sensor.

FIG. 42 is a control flowchart based on the detection result made by the flapper open/close detecting sensor 315.

When the user puts his or her hand in the handle part 6*a* and falls the flapper 303 down, the flapper open/close detecting sensor 315 is changed to be in the light-transmitting state from the light-shielding state. The flapper open/close detecting sensor 315 detects that the user puts his or her hand in the handle part 6*a* based on this (step S41).

When the flapper open/close detecting sensor 315 detects that the user puts his or her hand in the handle part 6*a*, it is checked whether or not paper is being fed (step S42). When the paper is being fed (image is being formed) (Yes at step S42), lock by the electric lock mechanism 160 is not cancelled and the processing is finished. With this, even when the user puts his or her hand in the handle part 6*a* to cancel the lock by the mechanical lock mechanism 300, the electric lock mechanism 160 still locks the drawer unit 76. This can prevent the drawer unit 76 from being drawn out while the paper is being fed.

When the paper is not being fed (image is not being formed) (No at step S42), it is checked whether paper is jammed based on the detection results by the above-mentioned paper detecting sensors (step S43). When the paper is jammed (Yes at step S43), the processing is finished and lock by the electric lock mechanism is cancelled based on the above-mentioned operation flow as illustrated in FIG. 31.

When the paper is not being fed (No at step S42) and the paper is not jammed (No at step S43), a power supply of 24V for supplying electric power to the fixing unit 53 and the secondary transfer device 52 held on the drawer unit 76 is shut off (step S44). When the power supply of 24V is shut off, the driving motor 701 is driven so as to cancel the lock by the electric lock mechanism 160 (step S45).

The above-mentioned series of operations (step S41) to (step S45) are completed before the user pushes the lever 305 and starts drawing the drawer unit 76. Specifically, the lock by the electric lock mechanism 160 can be cancelled completely before the user starts drawing the drawer unit 76 by adjusting the movement amount of the lever 305, for example. This makes it possible to draw out the drawer unit 76 at an arbitrary timing when the paper is not being fed and is not jammed. Furthermore, the drawer unit 76 can be drawn out without performing a specific operation for cancelling the lock by the electric lock mechanism when, for example, maintenance for the devices (fixing unit 53, secondary transfer device 52, and the like) held on the drawer unit 76 is performed.

Furthermore, after the lock by the electric lock mechanism 160 is cancelled, the control unit 121 starts time measurement. Then, when the drawer unit has not been drawn out after five seconds passes (Yes at step S46), the driving motor 701 is driven so as to lock the drawer unit 76 by the electric lock mechanism 160 (step S52). Note that the above-mentioned set detecting sensor 172 as illustrated in FIG. 17 is capable of detecting whether the drawer unit 76 has been drawn out. That is to say, when the set detecting sensor 172 does not shift to be in the light-transmitting state from the light-shielding state within five seconds, the control unit 121 drives the driving motor 701 so as to lock the drawer unit 76 by the electric lock mechanism 160. In this manner, when the drawer unit 76 has not been drawn within five seconds, the control unit 121 controls to lock the drawer unit 76 by the electric lock mechanism, thereby preventing the drawer unit 76 from being left as it is in the state where the lock by the electric lock mechanism is cancelled. Although the drawer unit 76 is locked by the electric lock mechanism in five seconds in the embodiment, it is sufficient that the time at which the lock is started is determined appropriately in consideration of characteristics and the like of the apparatus.

On the other hand, after the drawer unit 76 is drawn out within five seconds (step S47), maintenance or the like of the devices in the drawer unit 76 is finished, and the drawer unit 76 is set (step S48), it is checked whether the user's hand is put in the handle part 6*a* (step S49). When the flapper open/close detecting sensor 315 detects the state where the flapper 303 is opened, it is considered that the user's hand is put in the handle part 6*a* (Yes at step S49). That is to say, there is a risk that the user performs an operation of drawing out the drawer unit 76. In this case, the drawer unit 76 is not locked by the electric lock mechanism 160 so as to be made in a standby state. This can prevent the drawer unit 76 from being drawn out during the lock operation made by the electric lock mechanism 160.

On the other hand, when the flapper open/close detecting sensor 315 detects the state where the flapper 303 is closed and the user's hand is not put in the handle part 6*a* (No at step S49), there is no risk that the user performs the operation of drawing out the drawer unit 76. Accordingly, the driving motor 701 is driven so as to lock the drawer unit 76 by the electric lock mechanism 160 (step S50). After the drawer unit 76 is locked by the electric lock mechanism 160 completely, the power supply of 24V is turned ON (step S51).

Although the flapper 303 is provided in the embodiment, the flapper 303 may be omitted unless there is constraint in the appearance of the image forming apparatus. In this case, a non-contact sensor instead of the flapper open/close detecting sensor 315 detects that the user puts his or her hand so as to detect the drawing operation made by the user.

The above-mentioned embodiment is merely an example and the invention exhibits specific effects in the following respective aspects.

Aspect 1.

An image forming apparatus includes the drawer unit 76 that accommodates a paper-feeding conveying path such as the main conveying path 70 for conveying a recording medium such as paper conveyed from the paper feeding unit 3 on which the recording medium is loaded to an image forming unit such as the tandem image forming device 50 and/or a discharge conveying path such as the discharging path 60 for conveying the recording medium on which an image has been formed to a discharging unit, and is configured so as to be drawn out from an apparatus main body; a lock unit such as the lock mechanism 160 that locks the drawer unit 76 to the apparatus main body; a straddle detecting unit such as the straddle sensor that detects whether the recording medium straddles a conveying path in the apparatus main body and a conveying path in the drawer unit; and a controller that controls the lock unit to lock the drawer unit 76 to the apparatus main body when the straddle detecting unit detects straddle.

This configuration can prevent tearing of the recording medium such as the paper as described in the embodiment.

Aspect 2.

The image forming apparatus according to Aspect 1 further includes a driving unit such as the driving unit 700 that includes at least a driving source such as the driving motor 701 and drives the lock unit such as the lock mechanism 160; and a lock detecting unit such as a lock detecting mechanism that detects whether the lock unit is in a locking state or an unlocking state. In the image forming apparatus, the controller such as the control unit 121 controls the driving unit based on a detection result made by the lock detecting unit so as to control the lock unit.

This configuration can cause the drawer unit to be locked and unlocked automatically as described in the embodiment.

Aspect 3.

In the image forming apparatus according to Aspect 2, the driving unit such as the driving unit 700 includes at least a worm gear.

This configuration can prevent the lock unit such as the lock mechanism 160 from being rotationally moved due to vibration and the like and prevent lock failure and attachment failure of the drawer unit as described in the embodiment.

Aspect 4.

In the image forming apparatus according to any one of Aspects 1 to 3, a portion of an exterior cover of the apparatus main body, such as the front cover 6, arranged at a front side of the drawer unit 76 in a draw-out direction, the portion covering at least the drawer unit, is attached to the drawer unit so as to be drawn out integrally with the drawer unit.

This configuration can cause the drawer unit 76 to be drawn out by drawing out the exterior cover such as the front cover 6 as described in the embodiment. This can simplify the draw-out operation of the drawer unit.

Aspect 5.

The image forming apparatus according to any one of Aspects 1 to 4 further includes a lock receiving part, such as the lock receiving surfaces 182*a* and 182*b*, that abuts against the lock unit such as the lock mechanism 160 when the drawer unit 76 is locked to the apparatus main body. In the image forming apparatus, the lock receiving part provided at the drawer unit side relative to a rear side plate of the apparatus main body in the draw-out direction of the drawer unit 76, such as the main body rear side plate 501.

This configuration can prevent the lock mechanism from projecting to the rear side from the rear side plate such as the main body rear side plate 501 when the drawer unit is locked. With this, no constraint is received in arrangement of parts such as the secondary transfer roller that are provided at the rear side relative to the rear side plate. The parts, such as the secondary transfer roller, that are provided at the rear side relative to the rear side plate can be provided so as to be opposed to the lock receiving part, such as the lock receiving surfaces 182*a* and 182*b*. The degree of freedom of arrangement of the parts, such as the secondary transfer roller, that are provided at the rear side relative to the rear side plate can be enhanced. Furthermore, the size of the apparatus can be reduced.

Aspect 6.

In the image forming apparatus according to Aspect 5, the lock unit does not project from the rear side plate such as the main body rear side plate 501 when the lock unit such as the lock mechanism 160 abuts against the lock receiving part such as the lock receiving surfaces 182*a* and 182*b* and the drawer unit 76 is locked to the apparatus main body.

This configuration can enhance the degree of freedom of arrangement of the parts, such as the secondary transfer roller, that are provided at the rear side relative to the rear side plate as described in the embodiment. Furthermore, the size of the apparatus can be reduced.

Aspect 7.

The image forming apparatus according to any one of Aspects 1 to 6 further includes a paper jam detecting unit such as the paper detecting sensor that detects paper jam of the recording medium in a conveying path. In the image forming apparatus, when the straddle detecting unit such as the straddle sensor does not detect straddle and the paper jam detecting unit detects paper jam in the conveying path in the drawer unit, the controller such as the control unit 121 controls the lock unit such as the lock mechanism to unlock the drawer unit 76 from the apparatus main body.

This configuration can cause the drawer unit to be drawn out so as to remove the paper in the conveying path in the drawer unit easily when paper jam occurs in the conveying path in the drawer unit.

Aspect 8.

The image forming apparatus according to any one of Aspects 1 to 7 further includes an operating unit such as the handle part 6*a* that is operated by a user when the user draws out the drawer unit 76, and an operation detecting unit such as the flapper open/close detecting sensor 315 that detects whether the user operates the operating unit. In the image forming apparatus, when the operation detecting unit detects an operation of the operating unit, the controller such as the control unit 121 controls the lock unit such as the lock mechanism 160 to unlock the drawer unit 76 from the apparatus main body.

This configuration enables the user to draw out the drawer unit 76 without performing an operation for cancelling lock by the lock unit such as the lock mechanism 160 when, for example, maintenance of the drawer unit 76 is performed as described in the embodiment.

Aspect 9.

In the image forming apparatus according to Aspect 8, even when the operation detecting unit such as the flapper open/close detecting sensor 315 detects the operation of the operating unit such as the handle part 6*a*, if the straddle detecting unit such as the straddle sensor detects straddle or an image is being formed, the controller such as the control unit 121 controls the lock unit such as the lock mechanism 160 so as not to unlock the drawer unit.

This configuration can prevent tearing of the recording medium such as paper as described in the embodiment.

Aspect 10.

The image forming apparatus according to any one of Aspects 1 to 9 further includes a second lock unit such as the mechanical lock mechanism 300 that locks and unlocks the drawer unit with respect to the apparatus main body by a mechanical operation made by an operator.

With this configuration, even when the lock unit such as the lock mechanism 160 is in the unlocking state when the power supply is in the OFF state, the second lock unit such as the mechanical lock mechanism 300 is capable of locking the drawer unit as described in the embodiment. With this, the drawer unit 76 can be prevented from sliding out from the apparatus main body when, for example, the image forming apparatus is transported in the state where the power supply is in the OFF state. Furthermore, the second lock unit is capable of unlocking the drawer unit by an operation made by the user. This makes it possible to draw out the drawer unit 76 easily even when the power supply is in the OFF state and perform maintenance of the drawer unit easily when the power supply is in the OFF state.

Aspect 11.

The image forming apparatus according to any one of Aspects 1 to 10 further includes a handle part that opened for being handled by a hand of the user when the user draws out the drawer unit. In the image forming apparatus, an opening of the handle part is used as an air inlet for introducing outside air into the apparatus or an air outlet for discharging air in the apparatus.

This configuration can cool the inner portion of the image forming apparatus preferably while deterioration in designability of the image forming apparatus is prevented.

Aspect 12.

In the image forming apparatus according to any one of Aspects 1 to 11, the drawer unit 76 includes a notification unit, such as the LEDs 112*a* to 112*c*, that notifies the user of a place on the conveying path in the drawer unit at which the recording medium is jammed when the user draws out the drawer unit 76; and a wiring member such as the wire bundle 105 that electrically connects an inner portion of the apparatus main body and the drawer unit in a state where the drawer unit is drawn out from the apparatus main body.

With this configuration, the notification unit, such as the LEDs 112*a* to 112*c*, is capable of notifying the user of the paper jam place when the drawer unit 76 is drawn out from the apparatus main body as described in the embodiment. This makes it possible to remove the jammed paper in the drawer unit reliably.

Aspect 13.

In the image forming apparatus according to any one of Aspects 1 to 12, the drawer unit 76 includes a transfer unit such as the secondary transfer device 52 that includes a transfer member such as the secondary transfer roller 521 abutting against an image carrier such as the intermediate transfer belt 54 of the image forming unit and a contact/separation mechanism causing the transfer member to make contact with and be separated from the image carrier, and transfers an image on the image carrier onto the recording medium; and a driving unit such as the driving unit 700 that includes at least a driving source such as the driving motor 701 and drives the lock unit such as the lock mechanism 160 and the contact/separation mechanism. In the image forming apparatus, the contact/separation mechanism is configured to be driven such that the transfer member is made into a separated state from an abutting state with respect to the image carrier when the lock unit is driven to be in an unlocking state from a locking state.

This configuration can prevent, when the drawer unit 76 is drawn out from the apparatus main body, the image carrier such as the intermediate transfer belt 54 from being in slide contact with the transfer member such as the secondary transfer roller 521 as described in the embodiment.

According to the invention, when the straddle detecting unit detects straddle, the drawer unit is locked to the apparatus main body such that the drawer unit is not drawn out from the apparatus main body. This can prevent the drawer unit from being drawn out in a state where the recording medium straddles the conveying path in the drawer unit and the conveying path in the apparatus main body. With this, tearing of the recording medium can be prevented from occurring.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a drawer unit configured to include therein a paper-feeding conveying path for conveying a recording medium conveyed from a paper feeding unit on which the recording mediums are stacked to an image forming unit and/or a discharge conveying path for conveying the recording medium on which an image has been formed to a discharging unit, and be capably drawn out from an apparatus main body;

a lock unit configured to lock the drawer unit to the apparatus main body;

a straddle detecting unit configured to detect whether or not the recording medium straddles a conveying path in the apparatus main body and a conveying path in the drawer unit;

a controller configured to control the lock unit to lock the drawer unit to the apparatus main body when the straddle detecting unit detects the straddle;

an operating unit configured to be operated by a user when the user draws out the drawer unit; and an operation detecting unit configured to detect whether or not the user operates the operating unit, wherein when the operation detecting unit detects an operation of the operating unit, the controller controls the lock unit to unlock the drawer unit from the apparatus main body.

2. The image forming apparatus according to claim 1, further comprising:

a driving unit configured to include at least a driving source and drive the lock unit; and a lock detecting unit configured to detect whether the lock unit is in a locking state or an unlocking state, wherein the controller controls the driving unit based on a detection result obtained by the lock detecting unit so as to control the lock unit.

3. The image forming apparatus according to claim 2, wherein the driving unit includes at least a worm gear.

4. The image forming apparatus according to claim 1, wherein a portion of an exterior cover of the apparatus main body arranged at a front side of the drawer unit in a draw-out direction, the portion covering at least the drawer unit, is attached to the drawer unit so as to be drawn out integrally with the drawer unit.

5. The image forming apparatus according to claim 1, further comprising:

a lock receiving part configured to abut against the lock unit when the drawer unit is locked to the apparatus main body, wherein the lock receiving part is provided at the drawer unit side relative to a rear side plate of the apparatus main body in the draw-out direction of the drawer unit.

6. The image forming apparatus according to claim 5, wherein the lock unit does not project from the rear side plate when the lock unit abuts against the lock receiving part and the drawer unit is locked to the apparatus main body.

7. The image forming apparatus according to claim 1, further comprising:

a paper jam detecting unit configured to detect paper jam of the recording medium in a conveying path, wherein when the straddle detecting unit does not detect straddle and the paper jam detecting unit detects paper jam in the conveying path in the drawer unit, the controller controls the lock unit to unlock the drawer unit from the apparatus main body.

8. The image forming apparatus according to claim 1, wherein even when the operation detecting unit detects the operation of the operating unit, if the straddle detecting unit detects the straddle or an image is being formed, the controller controls the lock unit so as not to unlock the drawer unit.

9. The image forming apparatus according to claim 1, further comprising a second lock unit configured to lock and unlock the drawer unit with respect to the apparatus main body with a mechanical operation made by an user.

10. The image forming apparatus according to claim 1, further comprising:

a handle part configured to be opened for being handled by a hand of the user when the user draws out the drawer unit, wherein an opening of the handle part is used as an air inlet for introducing outside air into the apparatus or an air outlet for discharging air in the apparatus.

11. An image forming apparatus comprising:

a drawer unit configured to include therein a paper-feeding conveying path for conveying a recording medium conveyed from a paper feeding unit on which the recording mediums are stacked to an image forming unit and/or a discharge conveying path for conveying the recording medium on which an image has been formed to a discharging unit, and be capably drawn out from an apparatus main body;

a lock unit configured to lock the drawer unit to the apparatus main body, a straddle detecting unit configured to detect whether or not the recording medium straddles a conveying path in the apparatus main body and a conveying path in the drawer unit; and a controller configured to control the lock unit to lock the drawer unit to the apparatus main body when the straddle detecting unit detects the straddle, wherein the drawer unit includes a notification unit configured to notify the user of a place on the conveying path in the drawer unit at which the recording medium is jammed when the user draws out the drawer unit, and a wiring member configured to electrically connect an inner portion of the apparatus main body and the drawer unit in a state where the drawer unit is drawn out from the apparatus main body.

12. The image forming apparatus according to claim 11, further comprising:

a driving unit configured to include at least a driving source and drive the lock unit; and a lock detecting unit configured to detect whether the lock unit is in a locking state or an unlocking state, wherein the controller controls the driving unit based on a detection result obtained by the lock detecting unit so as to control the lock unit.

13. The image forming apparatus according to claim 11, further comprising:

a paper jam detecting unit configured to detect paper jam of the recording medium in a conveying path, wherein when the straddle detecting unit does not detect straddle and the paper jam detecting unit detects paper jam in the conveying path in the drawer unit, the controller controls the lock unit to unlock the drawer unit from the apparatus main body.

14. An image forming apparatus comprising:

a drawer unit configured to include therein a paper-feeding conveying path for conveying a recording medium conveyed from a paper feeding unit on which the recording mediums are stacked to an image forming unit and/or a discharge conveying path for conveying the recording medium on which an image has been formed to a discharging unit, and be capably drawn out from an apparatus main body;

a lock unit configured to lock the drawer unit to the apparatus main body;

a straddle detecting unit configured to detect whether or not the recording medium straddles a conveying path in the apparatus main body and a conveying path in the drawer unit; and a controller configured to control the lock unit to lock the drawer unit to the apparatus main body when the straddle detecting unit detects the straddle, wherein the drawer unit includes:

a transfer unit configured to include a transfer member that abuts against an image carrier of the image forming unit and a contact/separation mechanism that causes the transfer member to make contact with and be separated from the image carrier, and transfer an image on the image carrier onto the recording medium; and a driving unit configured to include at least a driving source to drive the lock unit and the contact/separation mechanism, and wherein the contact/separation mechanism is configured to be driven such that the transfer member is made into a separated state from an abutting state with respect to the image carrier when the lock unit is driven to be in the unlocking state from the locking state.

15. The image forming apparatus according to claim 14, further comprising:

a driving unit configured to include at least a driving source and drive the lock unit; and a lock detecting unit configured to detect whether the lock unit is in a locking state or an unlocking state, wherein the controller controls the driving unit based on a detection result obtained by the lock detecting unit so as to control the lock unit.

16. The image forming apparatus according to claim 14, further comprising:

a paper jam detecting unit configured to detect paper jam of the recording medium in a conveying path, wherein when the straddle detecting unit does not detect straddle and the paper jam detecting unit detects paper jam in the conveying path in the drawer unit, the controller controls the lock unit to unlock the drawer unit from the apparatus main body.

* * * * *